US011758336B2

(12) United States Patent
Mauger

(10) Patent No.: US 11,758,336 B2
(45) Date of Patent: Sep. 12, 2023

(54) COMBINATORY DIRECTIONAL PROCESSING OF SOUND SIGNALS

(71) Applicant: Cochlear Limited, Macquarie University (AU)

(72) Inventor: Stefan Jozef Mauger, Macleod (AU)

(73) Assignee: Cochlear Limited, Macquarie University (AU)

( * ) Notice: Subject to any disclaimer, the term of this patent is extended or adjusted under 35 U.S.C. 154(b) by 274 days.

(21) Appl. No.: 17/268,555

(22) PCT Filed: Oct. 24, 2019

(86) PCT No.: PCT/IB2019/059129

§ 371 (c)(1),
(2) Date: Feb. 15, 2021

(87) PCT Pub. No.: WO2020/089745

PCT Pub. Date: May 7, 2020

(65) Prior Publication Data

US 2021/0243533 A1 Aug. 5, 2021

Related U.S. Application Data

(60) Provisional application No. 62/860,858, filed on Jun. 13, 2019, provisional application No. 62/753,124, filed on Oct. 31, 2018.

(51) Int. Cl.
*H04R 25/00* (2006.01)
*G10L 25/18* (2013.01)
(Continued)

(52) U.S. Cl.
CPC ..... *H04R 25/407* (2013.01); *G10L 25/18* (2013.01); *H04R 1/406* (2013.01); *H04R 3/005* (2013.01);
(Continued)

(58) Field of Classification Search
None
See application file for complete search history.

(56) References Cited

U.S. PATENT DOCUMENTS 8,744,102 B2 * 6/2014 Klinkby ..... H04R 25/453 381/313
8,755,533 B2 6/2014 Banerjee et al.
(Continued)

FOREIGN PATENT DOCUMENTS

EP 2938098 A1 10/2015
JP 2005531175 A 10/2005
(Continued)

OTHER PUBLICATIONS

International Search Report and Written Opinion in counterpart International Application No. PCT/IB2019/059129, dated Jan. 31, 2020, 11 pages.
(Continued)

*Primary Examiner* — Paul W Huber
(74) *Attorney, Agent, or Firm* — Edell, Shapiro & Finnan, LLC

(57) ABSTRACT

Presented herein are techniques for generating a combinatory microphone signal from sounds captured at a microphone array. More specifically, sound signals captured by a microphone array are used to generate first and second directional signals. A cross-power signal is computed from the first and second directional signals. The cross-power signal is converted into an amplitude domain output signal, and a phase of the amplitude domain output signal is reconstructed in order to generate a combinatory microphone signal that is useable for subsequent sound processing operations.

29 Claims, 21 Drawing Sheets

(51) Int. Cl.

| | |
|---|---|
| ***H04R 1/40*** | (2006.01) |
| ***H04R 3/00*** | (2006.01) |
| ***H04R 3/04*** | (2006.01) |

(52) U.S. Cl.
CPC ..... *H04R 3/04* (2013.01); *H04R 25/405* (2013.01); *H04R 25/505* (2013.01)

(56) References Cited

U.S. PATENT DOCUMENTS

| | | | | |
|---|---|---|---|---|
| 8,965,003 | B2 * | 2/2015 | Rasmussen | H04R 3/005 381/92 |
| 10,356,514 | B2 * | 7/2019 | Elko | H04R 1/406 |
| 2014/0064529 | A1 | 3/2014 | Jang | |
| 2016/0366522 | A1 | 12/2016 | Hillbratt et al. | |

FOREIGN PATENT DOCUMENTS

| | | | |
|---|---|---|---|
| JP | 2013098705 | A | 5/2013 |
| JP | 2013142797 | A | 7/2013 |
| JP | 2016212285 | A | 12/2016 |
| WO | 2009/034524 | A1 | 3/2009 |
| WO | 2017/075589 | A1 | 5/2017 |

OTHER PUBLICATIONS

Dillon, H., "Hearing aids", Hodder Arnold, 2008, pp. 188-193.

Greenberg, J.E. and Zurek, P.M., 2001. Microphone-array hearing aids. In Microphone Arrays (Editors, Brandstein and Ward, pp. 229-253). Springer, Berlin, Heidelberg.

Extended European Search Report in counterpart European Application No. 19879850.6-1207, dated Jul. 6, 2022, 12 pages.

Shawe et al: "Theoretical and 1-15 Experimental Studies of the Resolution Performance of Multiplicative and Additive Aerial Arrays", Institution of Electronic and Radio Engineers. Proceedings of the Symposium on Signal Processing in Radar and Sonar Directional Systems; University of Birmingham, Jul. 6, 1964 (Jul. 6, 1964), pp. 279-291, XP001385447.

Kasilingam Dayalan et al: "Antenna 1-15 beamforming using multiplicative array processing", 2017 IEEE International Symposium on Antennas and Propagation & USNC/URSI National Radio Science Meeting, IEEE, Jul. 9, 2017 (Jul. 9, 2017), pp. 1387-1388, XP033229948, DOI: 10.1109/PUSNCURSINRSM.2017.8072736.

* cited by examiner

COMBINATORY DIRECTIONAL PROCESSING OF SOUND SIGNALS

BACKGROUND

Field of the Invention

The present invention generally relates to directional processing of sound signals.

Related Art

Hearing loss is a type of sensory impairment that is generally of two types, namely conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

In many people who are profoundly deaf, however, the reason for their deafness is sensorineural hearing loss. Those suffering from some forms of sensorineural hearing loss are unable to derive suitable benefit from auditory prostheses that generate mechanical motion of the cochlea fluid. Such individuals can benefit from implantable auditory prostheses that stimulate nerve cells of the recipient's auditory system in other ways (e.g., electrical, optical and the like). Cochlear implants are often proposed when the sensorineural hearing loss is due to the absence or destruction of the cochlea hair cells, which transduce acoustic signals into nerve impulses. An auditory brainstem stimulator is another type of stimulating auditory prosthesis that might also be proposed when a recipient experiences sensorineural hearing loss due to damage to the auditory nerve.

SUMMARY

In one aspect, a method is provided. The method comprises: determining a plurality of first frequency components associated with a first directional microphone signal; determining a plurality of second frequency components associated with a second directional microphone signal; multiplying the first frequency components with the second frequency components to generate a cross-power signal; converting the cross-power signal to the amplitude domain to generate an amplitude domain signal; and reconstructing a phase of the amplitude domain signal to generate a combinatory microphone signal.

In another aspect, a method is provided. The method comprises: receiving sound signals at a microphone array comprising first and second microphones positioned along a microphone axis; generating first and second directional signals from the sound signals received at the microphone array; calculating a frequency element wise cross power spectrum of the first and second directional microphone signals, in the frequency domain; generating an amplitude domain signal from the frequency element wise cross power spectrum; and reconstructing a phase of the amplitude domain signal to generate a combinatory microphone signal, wherein the combinatory microphone signal is associated with a microphone pickup pattern that has at least one area of broad-side sensitivity.

In another aspect, an auditory prosthesis is provided. The auditory prosthesis comprises: a microphone array comprising first and second microphones positioned along a microphone axis; a directional pre-processing module configured to generate first and second directional signals from the sound signals received at the microphone array; and a combinatory processing module configured to: calculate a frequency element wise cross power spectrum of the first and second directional microphone signals, in the frequency domain; generate an amplitude domain signal from the frequency element wise cross power spectrum; and reconstruct a phase of the amplitude domain signal to generate a combinatory microphone signal, wherein the combinatory microphone signal is associated with a microphone pickup pattern that has at least one area of broad-side sensitivity.

BRIEF DESCRIPTION OF THE DRAWINGS

Embodiments of the present invention are described herein in conjunction with the accompanying drawings, in which.

DETAILED DESCRIPTION

Presented herein are techniques for generating a combinatory microphone signal from sounds captured at a microphone array. More specifically, sound signals captured by a microphone array are used to generate first and second directional signals. A cross-power signal is computed from the first and second directional signals. The cross-power signal is converted into an amplitude domain output signal, and a phase of the amplitude domain output signal is reconstructed in order to generate a combinatory microphone signal, which that has at least one area of broad-side sensitivity and is useable for subsequent sound processing operations.

Merely for ease of description, the combinatory microphone techniques presented herein are primarily described herein with reference to one illustrative implantable auditory/hearing prosthesis, namely a cochlear implant. However, it is to be appreciated that the combinatory microphone techniques presented herein may also be used with a variety of other types of devices, including other auditory prostheses. For example, the techniques presented herein may be implemented in, for example, acoustic hearing aids, auditory brainstem stimulators, bone conduction devices, middle ear auditory prostheses, direct acoustic stimulators, bimodal auditory prosthesis, bilateral auditory prosthesis, etc. The combinatory microphone techniques presented herein may also be executed in any other device that includes a plurality of microphones (e.g., laptops, mobile phones, headsets, etc.). As such, description of the invention with reference to a cochlear implant should not be interpreted as a limitation of the scope of the techniques presented herein.

Figure 1A:
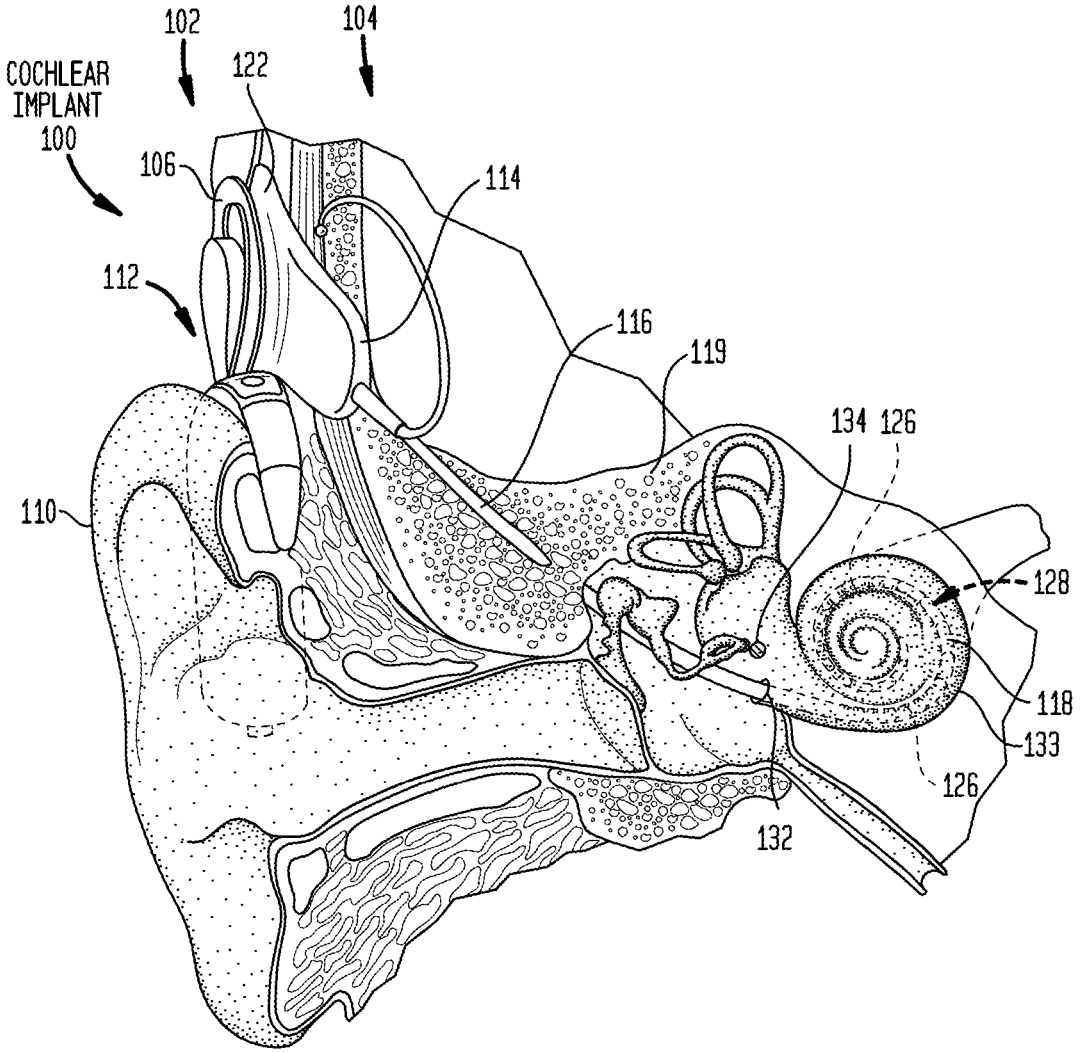
FIG. 1A is a schematic diagram illustrating a cochlear implant, in accordance with certain embodiments presented herein.
Figure 1B:
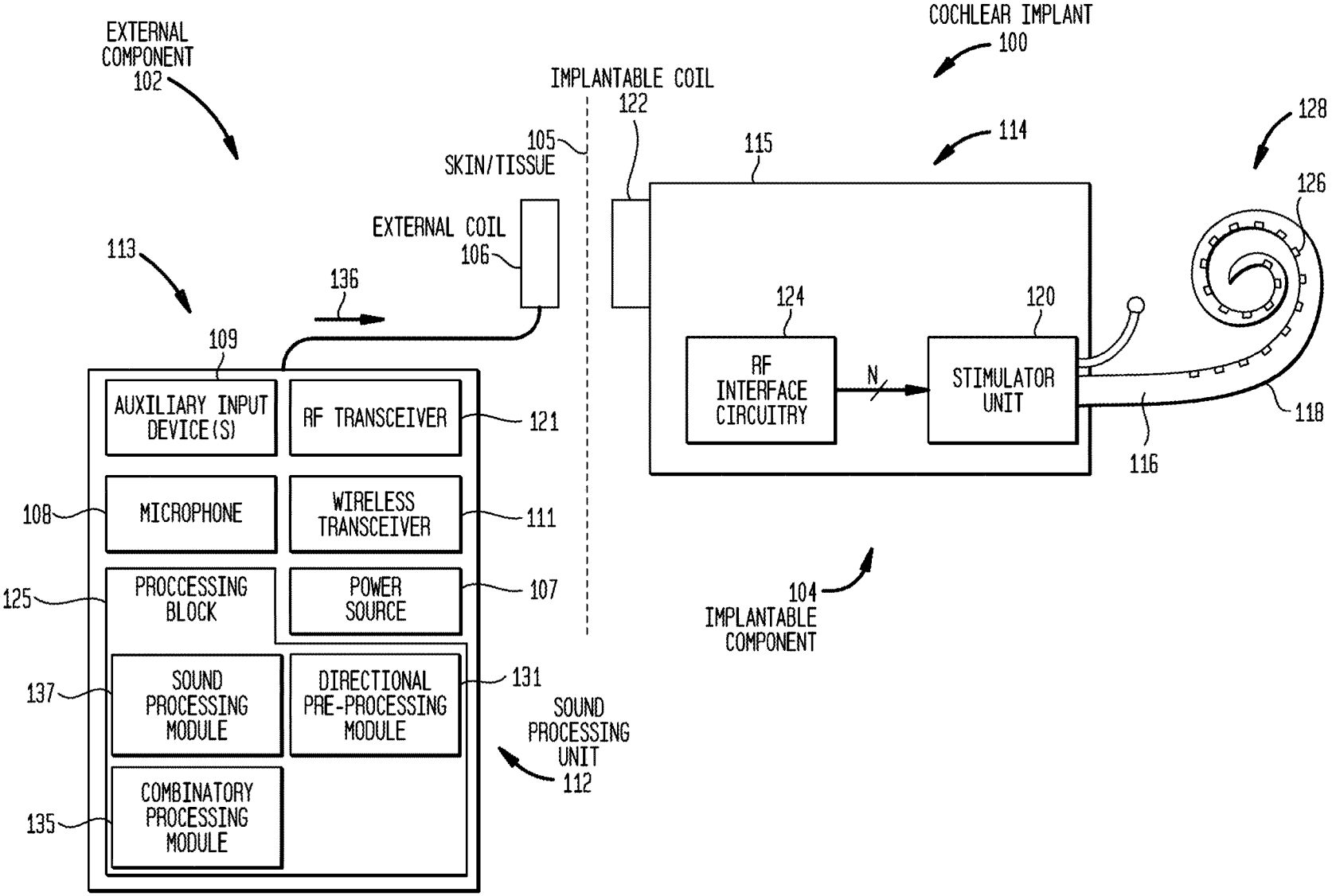
FIG. 1B is a block diagram of the cochlear implant of FIG. 1A.

FIG. 1A is a schematic diagram of an exemplary cochlear implant 100 configured to implement aspects of the combinatory microphone techniques presented herein, while FIG. 1B is a block diagram of the cochlear implant 100. For ease of illustration, FIGS. 1A and 1B will be described together.

The cochlear implant 100 comprises an external component 102 and an internal/implantable component 104. The external component 102 is directly or indirectly attached to the body of the recipient and typically comprises an external coil 106 and, generally, a magnet (not shown in FIG. 1) fixed relative to the external coil 106. The external component 102 also comprises one or more input elements/devices 113 for receiving input signals at a sound processing unit 112. In this example, the one or more input devices 113 include a plurality of microphones 108 (e.g., microphones positioned by auricle 110 of the recipient, telecoils, etc.) configured to capture/receive input acoustic/sound signals (sounds), one or more auxiliary input devices 109 (e.g., a telecoil, one or more audio ports, such as a Direct Audio Input (DAI), a data port, such as a Universal Serial Bus (USB) port, cable port, etc.), and a wireless transmitter/receiver (transceiver) 111, each located in, on, or near the sound processing unit 112.

In certain examples, the microphones 108 are referred to as "closely-spaced" microphones, meaning that the microphones are generally separated by less than 20 centimeters (cm). In further examples, the microphones 108 are referred to as "very closely-spaced" microphones, meaning that the microphones are generally separated by less than 2 cm. Auditory prostheses, in particular, have very closely-spaced microphones due to, for example, manufacturing constraints, the need to make the prostheses as small and unobtrusive as possible, need to be positioned on the head of a recipient, etc.

The sound processing unit 112 also includes, for example, at least one battery 107, a radio-frequency (RF) transceiver 121, and a processing block 125. The processing block 125 comprises a number of elements, including a directional pre-processing module 131, a combinatory processing module 135, and a sound processing module 137. Each of the directional pre-processing module 131, the combinatory processing module 135, and the sound processing module 137 may be formed by one or more processors (e.g., one or more Digital Signal Processors (DSPs), one or more uC cores, etc.), firmware, software, etc. arranged to perform operations described herein. That is, the directional pre-processing module 131, the combinatory processing module 135, and the sound processing module 137 may each be implemented as firmware elements, partially or fully implemented with digital logic gates in one or more application-specific integrated circuits (ASICs), partially or fully in software, etc.

As described further below, the combinatory processing module 135 is configured to generate a combinatory microphone signal based on the sounds captured by the plurality of microphones 108. More particularly, as described further below, the directional pre-processing module 131 generates two directional microphone signals from the captured sounds. These two directional signals are then processed by the combinatory processing module 135, as described further below, to generate the combinatory microphone signal.

Returning to the example embodiment of FIGS. 1A and 1B, the implantable component 104 comprises an implant body (main module) 114, a lead region 116, and an intra-cochlear stimulating assembly 118, all configured to be implanted under the skin/tissue (tissue) 105 of the recipient. The implant body 114 generally comprises a hermetically-sealed housing 115 in which RF interface circuitry 124 and a stimulator unit 120 are disposed. The implant body 114 also includes an internal/implantable coil 122 that is generally external to the housing 115, but which is connected to the RF interface circuitry 124 via a hermetic feedthrough (not shown in FIG. 1B).

As noted, stimulating assembly 118 is configured to be at least partially implanted in the recipient's cochlea 133. Stimulating assembly 118 includes a plurality of longitudinally spaced intra-cochlear electrical stimulating contacts (electrodes) 126 that collectively form a contact or electrode array 128 for delivery of electrical stimulation (current) to the recipient's cochlea. Stimulating assembly 118 extends through an opening in the recipient's cochlea (e.g., cochleostomy, the round window, etc.) and has a proximal end connected to stimulator unit 120 via lead region 116 and a hermetic feedthrough (not shown in FIG. 1B). Lead region 116 includes a plurality of conductors (wires) that electrically couple the electrodes 126 to the stimulator unit 120.

As noted, the cochlear implant 100 includes the external coil 106 and the implantable coil 122. The coils 106 and 122 are typically wire antenna coils each comprised of multiple turns of electrically insulated single-strand or multi-strand platinum or gold wire. Generally, a magnet is fixed relative to each of the external coil 106 and the implantable coil 122. The magnets fixed relative to the external coil 106 and the implantable coil 122 facilitate the operational alignment of the external coil with the implantable coil. This operational alignment of the coils 106 and 122 enables the external component 102 to transmit data, as well as possibly power, to the implantable component 104 via a closely-coupled wireless link formed between the external coil 106 with the implantable coil 122. In certain examples, the closely-coupled wireless link is a radio frequency (RF) link. However, various other types of energy transfer, such as infrared (IR), electromagnetic, capacitive and inductive transfer, may be used to transfer the power and/or data from an external component to an implantable component and, as such, FIG. 1B illustrates only one example arrangement.

As noted above, the processing block 125 includes sound processing module 137. The sound processing module 137 is configured to, in general, convert input audio signals into stimulation control signals 136 for use in stimulating a first ear of a recipient (i.e., the sound processing module 137 is configured to perform sound processing on input audio signals received at the one or more input devices 113). Stated differently, the sound processing module 137 (e.g., one or more processing elements implementing firmware, software, etc.) is configured to convert the captured input audio signals into stimulation control signals 136 that represent electrical stimulation for delivery to the recipient. The input audio signals that are processed and converted into stimulation control signals may be audio signals received via the sound input devices 108 and, as described further below, pre-processed by the directional pre-processing module 131 and the combinatory processing module 135.

In the embodiment of FIG. 1B, the stimulation control signals 136 are provided to the RF transceiver 121, which transcutaneously transfers the stimulation control signals 136 (e.g., in an encoded manner) to the implantable component 104 via external coil 106 and implantable coil 122. That is, the stimulation control signals 136 are received at the RF interface circuitry 124 via implantable coil 122 and provided to the stimulator unit 120. The stimulator unit 120 is configured to utilize the stimulation control signals 136 to generate electrical stimulation signals (e.g., current signals) for delivery to the recipient's cochlea via one or more stimulating contacts 126. In this way, cochlear implant 100 electrically stimulates the recipient's auditory nerve cells, bypassing absent or defective hair cells that normally transduce acoustic vibrations into neural activity, in a manner that causes the recipient to perceive one or more components of the input audio signals.

FIGS. 1A and 1B illustrate an arrangement in which the cochlear implant 100 includes an external component. However, it is to be appreciated that embodiments of the present invention may be implemented in cochlear implants having alternative arrangements. For example, elements of the sound processing unit 112 (e.g., such as the processing block 125, power source 102, etc.), may be implanted in the recipient.

Directional microphone systems/arrays are formed by a plurality of individual microphones (e.g., omni-directional microphones) where the sounds detected by the each of the individual microphones are combined through digital signal processing (or historically through analogue or physical combination). In general, there are two conventional classes of directional microphone systems, namely additive microphone systems and differential microphone systems. Proposed herein is a new class of directional microphone systems, referred to as a "combinatory" microphone system in which two directional signals are used to generate a combinatory microphone signal that has features of both input directional signals. One implementation of a combinatory directional microphone is able to produce primary or supplemental "off-axis" or "broad-side" directionality/sensitivity. As used herein, off-axis or broad-side sensitivity refers to a pickup pattern that captures sound signals received at one or more angles relative to the microphone axis (i.e., the line along which the plurality of microphones are positioned). Typically, delay-and-sum structure directional microphones are sensitive to the end-fire direction, not the broad-side direction.

Additive microphone systems synchronize and add the microphone array sensor outputs. It is broadly understood for acoustic signals that additive microphone systems are a collective for all the directional microphone arrays with large inter-element spacing and optimal gain in broadside direction (orthogonal to the microphone array axis, in the case of linear arrays). In differential microphone systems, one signal received at a first microphone is subtracted from the signal received at a second microphone to exploit time differences between the signals. It is broadly understood that differential directional microphone systems are a collective for all the directional microphone arrays which small inter-element spacing and have optimal gain in the end-fire direction (in the direction of the microphone array axis, in the case of linear arrays).

The distinction between additive (broadside) and differential (end-fire) directional microphone systems is determined by whether the acoustic wavelength, $\lambda$, is smaller than the distance between microphones, $\delta$ (i.e., whether $\lambda<\delta$). As noted, many devices are small and require microphones to be located close to each other (i.e., closely-spaced or very closely-spaced microphones). As noted, auditory prostheses (e.g., hearing aids, bone conduction devices, cochlear implants, etc.) in particular, generally use very closely-spaced microphones, while a range of other devices such as, mobile phones, wireless streaming devices, recording devices, etc., may also use closely-spaced or very closely-spaced microphones.

Acoustic signals have a wide range of useful frequencies for human listening. The widest limits of these are assumed to be between 20 Hertz (Hz) and 20 kilohertz (kHz). The range of acoustic frequencies particularly useful in small devices is usually more limited than this, in the range of 100 Hz to 10 kHz and particularly frequencies around 1 kHz. Frequency must be considered to understand the differential microphone distance. Equation 1, below, describes the general understanding of close spaced microphones when considering frequency.

$$\frac{\delta f}{c} < 1, \qquad \text{Equation 1}$$

where f is the frequency of the signal (inverse of the wavelength λ), δ is the distance between the microphones in meters, and c is the speed of sound.

The simplest directional microphone systems have two (2) omnidirectional microphones, where a noisy signal is received at both microphones. For a speech signal (x) and a noise signal (n), the noisy speech signal under additive assumptions is given as shown below in Equation 2.

$$y_i(t)=x_i(t)+n_i(t), \quad \text{Equation 2}$$

where t is the time and i is the microphone index.

For close spaced microphones (less than approximately 3.4 cm), a range of first order directional microphone shapes are possible. In the time domain, standard first-order differential polar patterns can be calculated through real-time windowed delay and subtract methods. For instance, forward-facing cardoid, rear facing cardioid, super cardioid, hyper cardioid, and figure-8 patterns can be created. The general first order (FO) differential delay and subtract is described as shown below in Equation 3.

$$y_{FO}(t)=y_1(t+d_1)-y_2(t+d_2), \quad \text{Equation 3}$$

where $d_1$ and $d_2$ are electrical delays of a signal for each of the two microphones. For a signal coming from the direction of the microphone axis, the time delay between a signal from one microphone to the second microphone can be determined from Equation 4, below.

$$d=\delta/c \quad \text{Equation 4}$$

Figure 2:
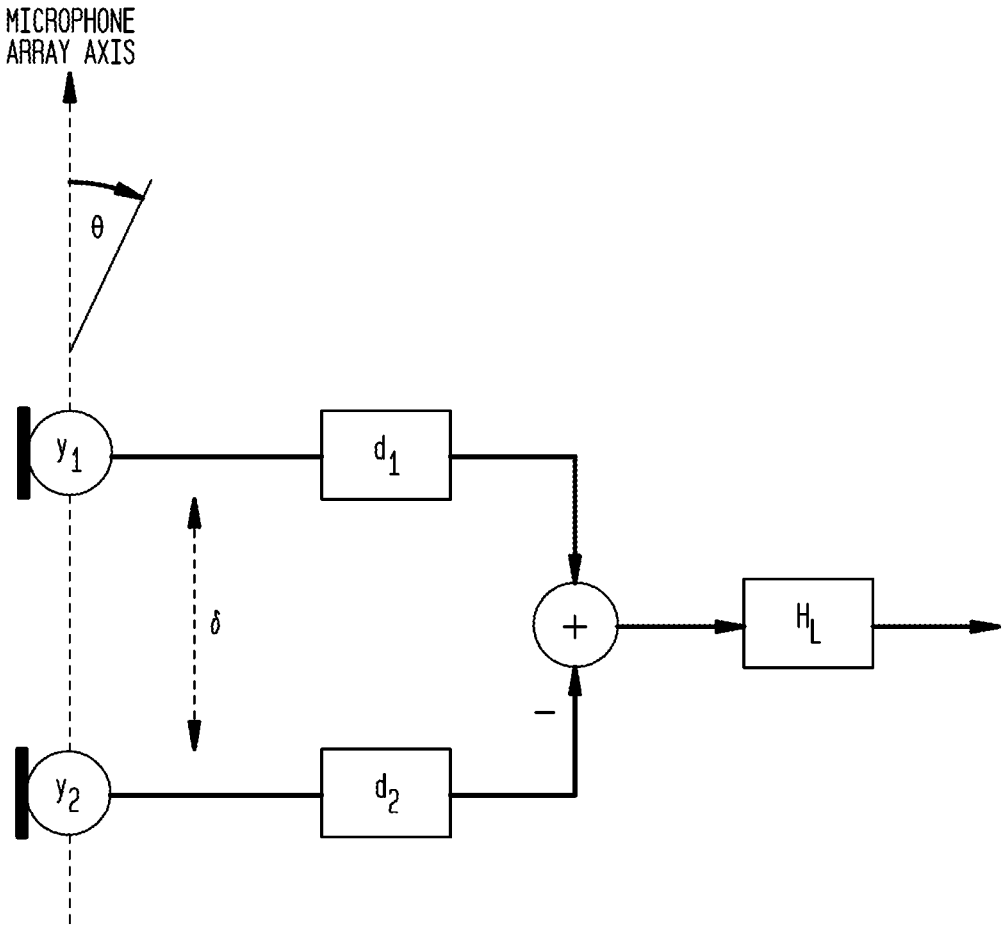
FIG. 2 is a general block of a first-order directional microphone system.
Figure 3:
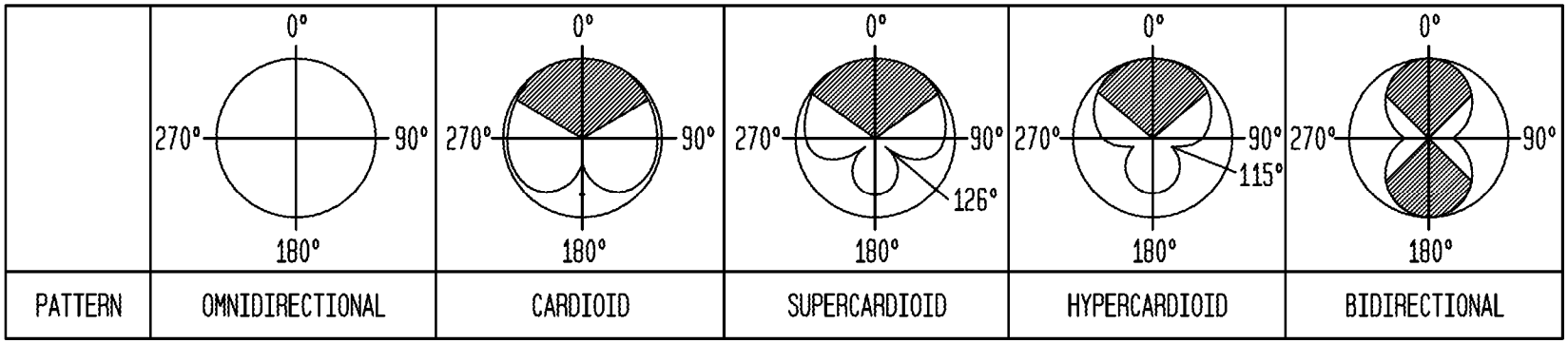
FIG. 3 is a diagram depicting common directional microphone patterns.

FIG. 2 is a general block of a first-order directional microphone system (with two microphones). By changing the delay of the two delays ($d_1$ and $d_2$), the full array of first-order directional microphone patterns can be formed, as shown below in Table 1. Common directional microphone polar responses are also depicted in FIG. 3.

TABLE 1

Figure 8:
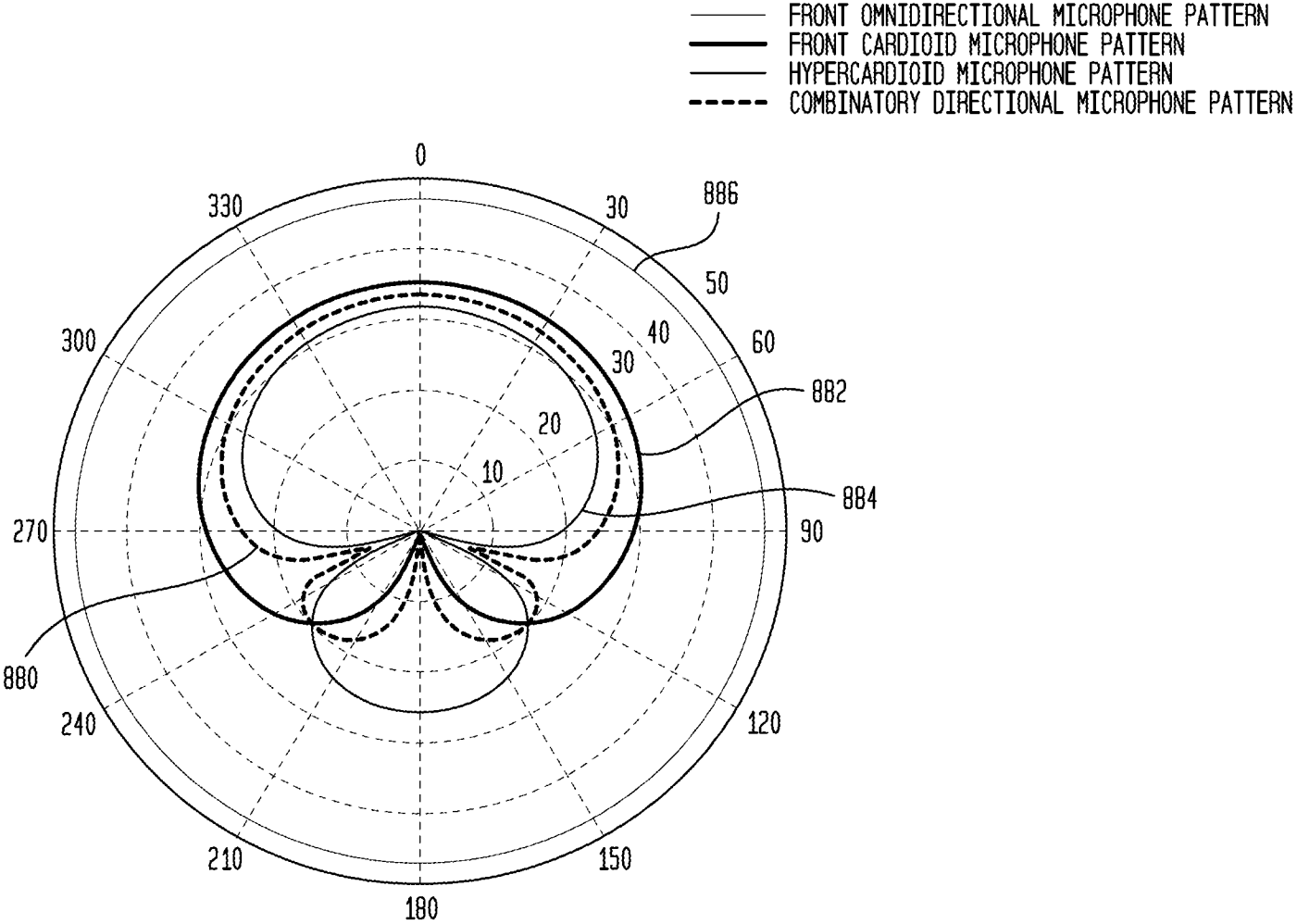
FIG. 8 is a polar plot illustrating a polar pattern associated with a combinatory directional microphone signal, in accordance with certain embodiments presented herein.

| First Order Microphone Pattern | $d_1$ | $d_2$ |
|---|---|---|
| Front-facing Cardioid | 0 | δ/c |
| Rear-facing Cardioid | δ/c | 0 |
| FIG.-8 (bidirectional) | 0 | 0 |
| Super Cardioid | 0 | 0.577* δ/c |
| Hyper Cardioid | 0 | 0.333* δ/c |

The omni-directional microphone pattern can be achieved with one single microphone. The first order directional microphone patterns of cardioid, super cardioid, hyper cardioid and figure-8 (bidirectional) are achieved with the differential arrangement.

A problem with conventional directional microphone systems is that they have the direction of greatest sensitivity in the direction of the microphone axis (e.g., either forwards or backwards on close spaced unilateral systems, in the direction of the axis on which the Stated differently, these conventional directional microphone systems are unable to have the direction of greatest sensitivity in a different direction, such as orthogonal to the microphone axis, without the aid of a separate/remote microphone placed some distance from the directional microphone system (e.g., on the other ear). Off-axis sensitivity for a directional microphone system, without the requirement for a remote microphone, may be advantageous in a number of different devices.

As such, presented herein are microphone processing techniques, referred to as combinatory microphone techniques or a combinatory microphone system, in which two directional signals are used to generate a combinatory microphone signal that has off-axis sensitivity for sound signals detected by microphone array. More specifically, in accordance with the combinatory microphone techniques presented herein, a plurality of microphones forming a microphone array each capture sound signals. The plurality of microphones each output a corresponding microphone signal and these microphone signals are combined through a spectral cross correlation process. After application of a Fourier transform to each microphone signal, the microphone signals can each be expressed in the frequency domain as shown below in Equation 5.

$$Y_{FO}(\omega,k)=FFT(y_{FO}(t)), \quad \text{Equation 5}$$

where k is the frame index and ω=2πl/L and where 1=1, 2, 3 . . . L−1 and L is the frame length.

To create a combinatory directional microphone signal in accordance with the techniques presented herein, the element wise cross power spectrum (power spectrum density) of the directional microphone signals, in the frequency domain, is computed as shown below in Equation 6.

$$\Phi\Phi_{CDM}(\omega,k)=Y_{FO1}(\omega,k)Y_{FO2}(\omega,k) \quad \text{Equation 6}$$

To recreate the time domain signal, the cross power signal is converted back to an amplitude/magnitude signal (e.g., via application of the square root which under some circumstances has the property of being real, or with the use of the absolute function, which results in a phase symmetric for both the left and right directional microphone signals). This results in an amplitude combinatory directional microphone signal. Then, in certain embodiments, an inverse Fourier transform may be applied to the combinatory directional microphone signal φ into an amplitude signal in the time domain. The combination of these processes is shown below in Equation 7.

$$\varphi(t)=\text{IFFT}(|\sqrt{\Phi\Phi_{CDM}(\omega,k)}|)$$

Figure 4A:
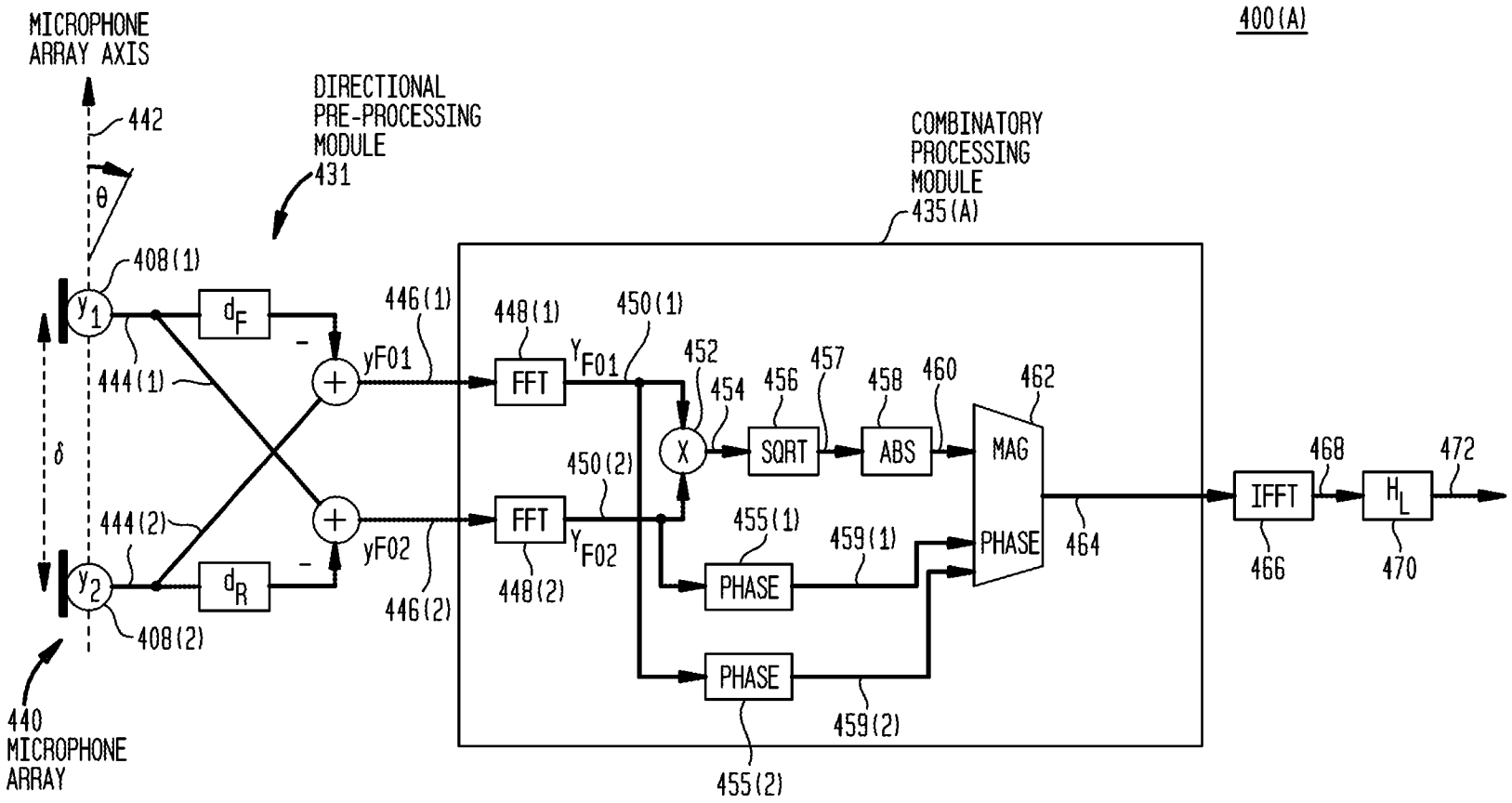
FIG. 4A is functional block diagram illustrating a portion of a device configured to generate a combinatory directional microphone signal, in accordance with certain embodiments presented herein.

FIG. 4A generally illustrates a portion of a device 400(A) configured to generate a combinatory directional microphone signal from any two first order microphone signals, FO1 and FO2. Device 400(A) may be, for example, an auditory prosthesis (e.g., cochlear implant, hearing aid, bone conduction device, etc.), a mobile phone, a laptop, a headset, headphones etc.

FIG. 4A illustrates a microphone array 440 that comprises a first microphone 408(1) and second microphone 408(2). The microphones 408(1) and 408(2) are disposed along a microphone array axis 442, and separated by a distance, δ. In an auditory prosthesis worn on the head of a recipient, the microphone array axis 442 is generally parallel to the side of the recipient's head and the first microphone 408(1) is located relatively closer to the front of the head of the recipient, while the second microphone 408(2) is located closer to the back of the head of the recipient.

The first microphone 408(1) generates a first microphone signal 444(1), y1, while the second microphone 408(2) generates a second microphone signal 444(2), y2. As shown, the device 400(A) includes a directional pre-processing module 431 that is configured to implement windowed delay and subtract methods (e.g., in accordance with Equations 3 above) to create two first order directional microphone signals 446(1) and 446(2), referred to as $y_{F01}$ and $y_{F02}$, respectively, from the first and second microphone signals 444(1) an 444(2). Directional microphone signals 446(1) and 446(2) are in the time domain, similar to the sound captured by the microphone 440 and the microphone signals 444(1) and 444(2).

The device 400(A) also comprises a combinatory processing module 435(A) configured to implement aspects of the combinatory microphone techniques presented herein. As shown in FIG. 4A, the two first order directional microphone signals 446(1) and 446(2) (i.e., yF01 and yF02) are provided to the combinatory processing module 435(A) and, as described further below, used to generate a combinatory directional microphone signal 464.

The two first order directional microphone signals 446(1) and 446(2) are amplitude signals in the time domain. At blocks 448(1) and 448(2), respectively, a Fourier transform (e.g., a fast Fourier transform (FFT), short-time Fourier transform (STFT), discrete Fourier transform (DFT), other frequency domain type transforms etc.) is applied to each of the directional microphone signals 446(1) and 446(2), where directional microphone signals can be expressed in the frequency domain as shown above Equation 5. In general, the Fourier transform blocks 448(1) and 448(2) are understood as the buffering, windowing, and a Fourier transform process that separates the signals into a plurality of frequency components.

The frequency domain versions of the directional microphone signal 446(1) and the directional microphone signal 446(2) are referred to as frequency domain directional microphone signal 450(1) ($Y_{F01}$) and frequency domain directional microphone signal 450(2) ($Y_{F02}$), respectively. Frequency domain directional microphone signals 450(1) and 450(2) are representations of an amplitude signal, but in the frequency domain and include imaginary parts. In other words, at processing block 448(1), a plurality of frequency components associated with a first directional signal (i.e., directional microphone signal 446(1)) are determined and, at processing block 448(2), a plurality of frequency components associated with a second directional signal (i.e., directional microphone signal 446(2)) are determined.

At processing block 452, an element wise multiplication is performed to determine the cross-power spectrum 454 (i.e., a cross-power signal) of the directional microphone signals 450(1) and 450(2) (e.g., as described above with reference to in Equation 6). That is, at 452, a plurality of frequency components associated with a first directional signal (i.e., directional microphone signal 446(1)) are multiplied with a plurality of frequency components associated with a second directional signal (i.e., directional microphone signal 446(2)).

In the example of FIG. 4A, the cross-power signal 454 is converted to an amplitude or magnitude signal via processing blocks 456 and 458. More specifically, at processing block 456, a square root of the cross-power signal 454 is calculated to generate an intermediate signal 457 (which in some cases is used as the combinatory directional microphone signal 464 without the need of magnitude and phase block 462 as it contains amplitude information, as shown in FIG. 4C). At 458, the absolute operator is used to determine the magnitude of the signal. FIG. 4A illustrates an example in which any imaginary parts of the intermediate signal 457 are removed by calculating an absolute value of the intermediate signal 457. However, in alternative embodiments, any imaginary parts of the intermediate signal 457 may be removed by computing the real part of the intermediate signal 457. Regardless of the specific procedure, the result is conversion of the intermediate signal 457 into a magnitude or amplitude domain signal 460.

The computation of the cross-power signal 454 (element wise cross-power spectrum) results in a loss of meaningful phase information from the directional microphone signals 450(1) and 450(2). Therefore, at processing block 462, the phase of the amplitude domain signal 460 is reconstructed from (based on) a phase of, for example, one or more of the directional microphone signals 450(1) and 450(2). The resulting signal, (I), is the combinatory directional microphone signal 464 (i.e., amplitude domain output signal with the reconstructed phase), sometimes referred to herein as combinatory signal 464.

To obtain the phase information, the combinatory processing module 435(A) includes phase extraction blocks 455(1) and 455(2). The phase extraction blocks 455(1) and 455(2) receive the directional microphone signals 450(1) and 450(2), respectively, and extract phase information therefrom. This phase information, sometimes referred to herein as a phase signal, extracted from directional microphone signal 450(1) is represented in FIG. 4A by arrow 459(1), while the phase information extracted from directional microphone signal 450(2) is represented in FIG. 4A by arrow 459(2). Although FIG. 4A illustrates the extraction of the phase information from both of the directional microphone signals 450(1) and 450(2), it is to be appreciated that other embodiments may only extract and use the phase from one of the directional microphone signals 450(1) and 450(2).

In certain examples, the processing block 462, or another element, is configured to generate a longer term amplitude estimate of the sound signals received at the microphone array 440. The processing block 462 is configured to adjust a shorter term power signal of combinatory directional microphone signal 464 so as to approximate the longer term amplitude estimate of the sound signals. More specifically, the cross-power spectrum (power signal) 454 does not have natural growth, in that, for example, it gets 20 dB softer for every 10 dB decrease in the actual sound environment level. If the sound signals indicate that the environment level is, say, around 60 dB, then it may be desirable to match the power CDM to this level so it is about the same level. If the environmental signal changes to 80 dB (20 dB louder) then the power CDM will be at 100 dB (40 dB louder). Although it may not be desirable to change the short term amplitude and undo the pattern (e.g., cardioid), it may be desirable to change the longer term amplitude to match the listening level to the environment. In the second case, the system may turn the signal down by 20 dB, slowly (maybe over seconds), to match the longer term environmental loudness.

In certain examples, the phase information from directional microphone signal 450(1) may be used to reconstruct the phase of the of the amplitude domain signal 460. In other embodiments, the phase information from directional microphone signal 450(2) may be used to reconstruct the phase of the of the amplitude domain signal 460. In still other embodiments, block 462 may be configured to use the phase information from both of the directional microphone signals 450(1) and 450(2). For example, in one embodiment, block 462 may be configured to compute a mean of the phase information extracted from the directional microphone signals 450(1) and 450(2). In another example, block 462 may be configured to compute the weighted mean (by vector magnitude for example) of the phase information extracted from the directional microphone signals 450(1) and 450(2).

Returning to the specific example of FIG. 4A, the device 400(A) also includes an inverse Fourier transform block 466. That is, at block 466, an inverse Fourier transform (e.g., inverse fast Fourier transform (IFFT), inverse discrete Fourier transform (IDFT), inverse short time Fourier transform (ISTFT), or other conversion from the frequency to the time domain transform) is applied to the combinatory signal 464 in order to convert the combinatory signal 464 into the time domain. At the output of the inverse Fourier transform block 466, the combinatory signal 464 is referred to as time-domain amplitude combinatory signal 468.

FIG. 4A also illustrates that device 400(A) includes a time domain frequency filter (HL) 470. In this embodiment, the frequency filter 470 provides frequency specific gain to the signal to make the time-domain combinatory signal 468 flat across frequency, in the case of the operations in the combinatory processing module 435(A) amplifies the low frequencies for instance. Stated differently, the frequency filter 470 is provided to compensate for unintended frequency shaping introduced in the directional microphone signals (e.g., aim to make it the output flat, or to have a specific frequency shape). The frequency filter 470 also has a second purpose in that it would also apply a high pass function at a certain frequency to remove any aliasing from insufficient FFT length, as described further below. At the output of the frequency filter 470, the time-domain combinatory signal is referred to as frequency-adjusted combinatory signal 472.

As noted above, in order to ensure that combinatory directional microphone signal includes minimal audible distortion, the phase information can be reconstructed. That is, the signal amplitude signal is computed from the cross-power spectrum, but this computation introduces phase distortions that need to be addressed. In the example of FIG. 4A, the phase information is reconstructed from one or both of the directional microphone signals 450(1) and 450(2). However, it is to be appreciated that the phase information can be reconstructed from signals available at different locations/points within the processing chain.

Figure 4B:
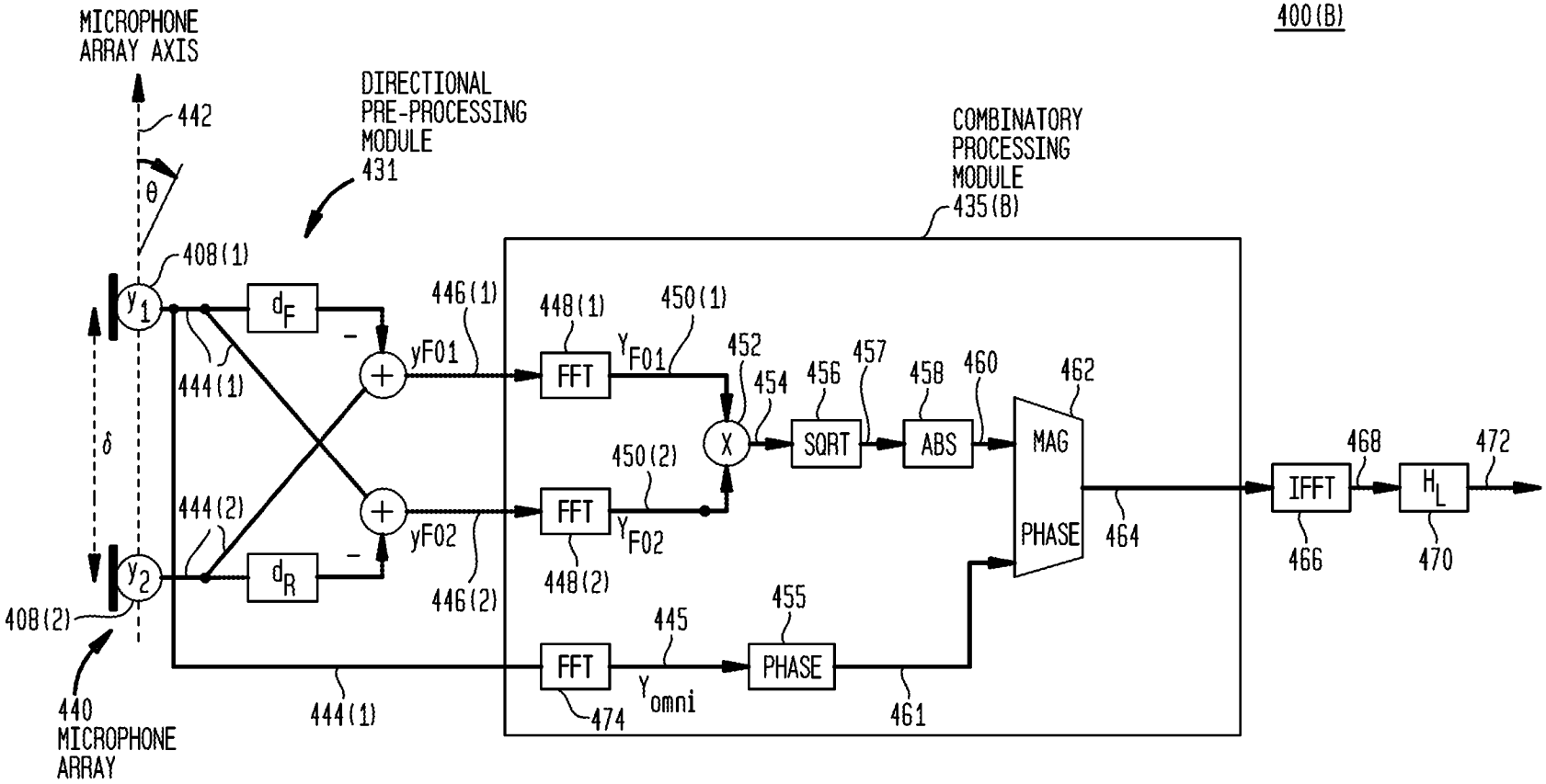
FIG. 4B is functional block diagram illustrating a portion of another device configured to generate a combinatory directional microphone signal, in accordance with certain embodiments presented herein.
Figure 4C:
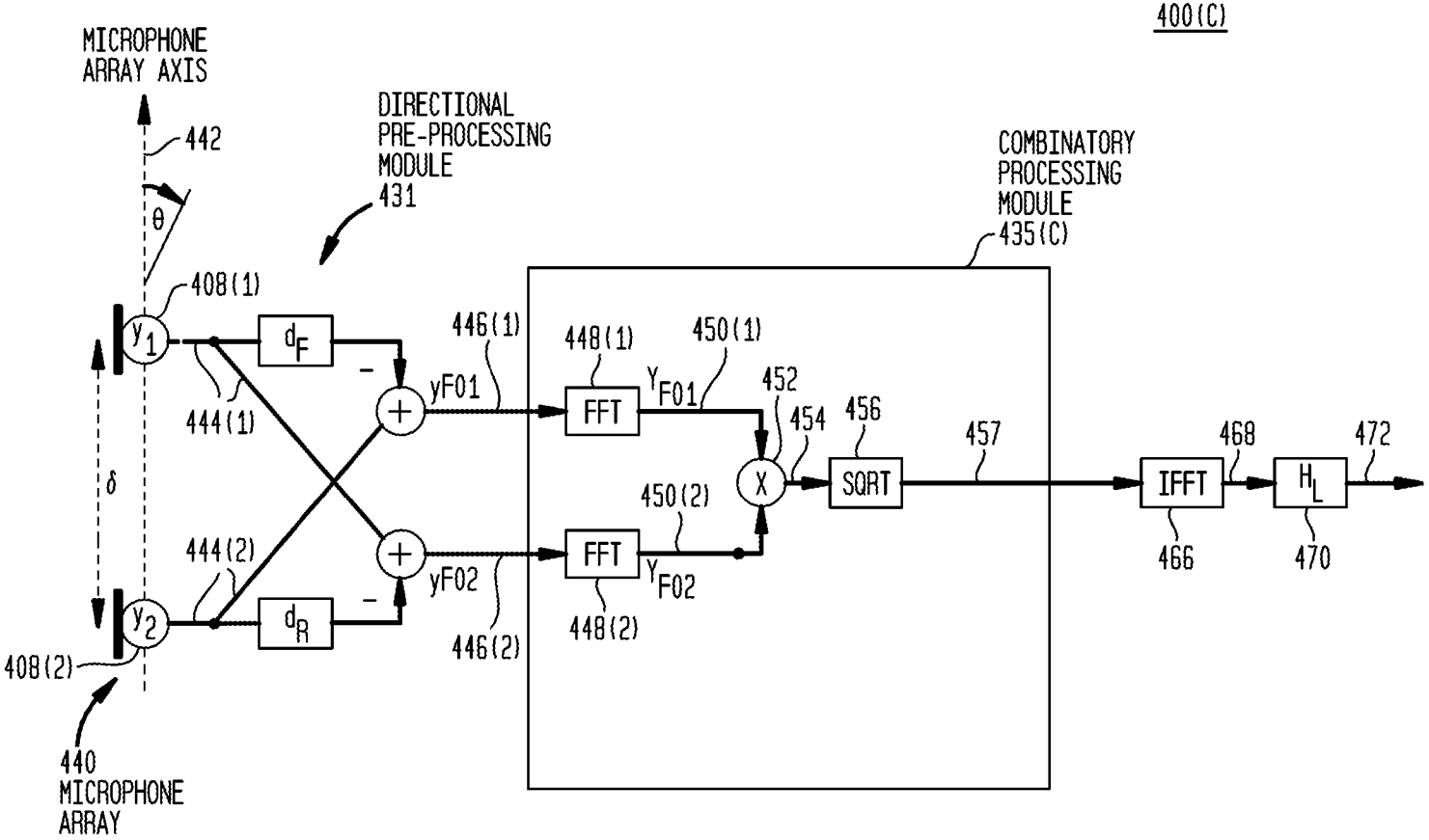
FIG. 4C is functional block diagram illustrating a portion of another device configured to generate a combinatory directional microphone signal, in accordance with certain embodiments presented herein.

For example, FIG. 4B illustrates a device 400(B) (e.g., auditory prosthesis, mobile phone, laptop, headset, headphones etc.) that, similar to device 400(A) of FIG. 4A, comprises microphone array 440, directional pre-processing module 431, inverse Fourier transform block 466, and frequency filter 470. Device 400(B) also comprises a combinatory processing module 435(B) which is similar to combinatory processing module 435(A), except that, in FIG. 4B, the phase information is reconstructed from the first microphone signal 444(1) (i.e., y1, the front omnidirectional microphone signal). To this end, the combinatory processing module 435(B) comprises, in addition to the elements described with reference to FIG. 4A, an additional Fourier transform block 474. The additional Fourier transform block 474 receives the first microphone signal 444(1) and applies a Fourier transform (e.g., a fast Fourier transform (FFT), short-time Fourier transform (STFT), discrete Fourier transform (DFT), etc.) thereto. The frequency domain version of the first microphone signal 444(1) is referred to as frequency domain front microphone signal 445 ($Y_{omni}$ or Y1).

To obtain the phase information, the combinatory processing module 435(B) includes a phase extraction block 455. The phase extraction block 455 receives the frequency domain front microphone signal 445 and extracts phase information therefrom. This phase information, sometimes referred to herein as a phase signal, extracted from the frequency domain front microphone signal 445 is represented in FIG. 4B by arrow 461. Although FIG. 4B illustrates the reconstruction of the phase information from only the first microphone signal 444(1), it is to be appreciated that other embodiments may also or alternatively obtain the phase from second microphone signal 444(2), in a similar or different manner.

FIGS. 4A and 4B illustrate several locations from which phase information may be extracted and used to reconstruct the phase of the amplitude domain signal 460. It is to be appreciated that these locations are illustrative and that the phase information may be extracted from any other individual signals, or combinations of signals, within the processing chain.

It is also to be appreciated that, in certain embodiments, the phase reconstruction could be admitted (e.g., directly use the output of the square root). FIG. 4C illustrates one such an arrangement. In FIG. 4C, a device 400(C) (e.g., auditory prosthesis, mobile phone, laptop, headset, headphones etc.) is similar to device 400(A) of FIG. 4A and comprises microphone array 440, directional pre-processing module 431, inverse Fourier transform block 466, and frequency filter 470. Device 400(C) also comprises a combinatory processing module 435(C) which is similar to combinatory processing module 435(A), except that, in FIG. 4C, blocks 458 and 462, as well as the phase reconstruction are all omitted. To this end, the output of block 456, intermediate signal 457, is provided to the IFFT 468 for subsequent processing.

There are a number of unique attributes of the combinatory microphone techniques presented herein. For example, in certain embodiments, the microphones (e.g., microphones 408(1) and 408(2)) are temporally symmetrical. This means that the Front—Rear delay is the inverse of the Rear-Front delay. Additionally, the Fourier transform window (e.g., the length of FFTs 448(1) and 448(2)) needs to be of sufficient length to provide sufficient frequency resolution so that lower frequencies are not amplitude modulated due to a phase shift. For example, FFT lengths of 128 may operate with frequencies right down to as low as, for example, 200 Hz. In another example, FFT lengths of 256 may operate with lower frequencies right down to as low as, for example, 100 Hz. As such, the Fourier transform window provides sufficient spectral resolution to mitigate any modulation and aliasing problems. Additionally, low frequency FFT bins (channels) which are expected to have aliasing can be dealt with in a number of ways. One way is to produce a high-pass filter to remove the aliased frequencies, and combine this with a low pass signal not processed by the combinatory processing. Another way is to apply the combinatory processing to FFT bins above a certain point, and not to process the low frequency 1, 2, 3, 4, or 5 frequency bins, for instance.

As noted, FIGS. 4A and 4B generally illustrate arrangements in which directional pre-processing module 431 generates two first order directional microphone signals 446(1) and 446(2) that are processed by the combinatory processing modules 435(A) and 435(B). However, it is to be appreciated that any directional microphone signal, such omnidirectional microphones, second order directional microphone signals, third order directional microphones, or even a combinatory directional microphone signal could be input into a combinatory processing module (i.e., processed in accordance with the combinatory microphone techniques presented herein). FIGS. 5-8 and 10-14 are polar plots illustrating the results of processing of different combinations of directional microphone signals using the combinatory microphone techniques presented herein.

In the examples of FIGS. 5-8 and 10-14, the various illustrated microphone patterns are generated from microphones forming part of a microphone array, where the microphones are disposed on a microphone axis. In each polar plot of FIGS. 5-8 and 10-14, the microphone axis connects the zero (0) degree and the one hundred and eight (180) degree points, where the 0 degree point is defined as the front (e.g., the front of the head of the recipient, the direction the recipient is looking, etc.) and the 180 degree point is defined as the back (e.g., the back of the head of the recipient, the direction that is directly opposite to the direction the recipient is looking, etc.).

Figure 5:
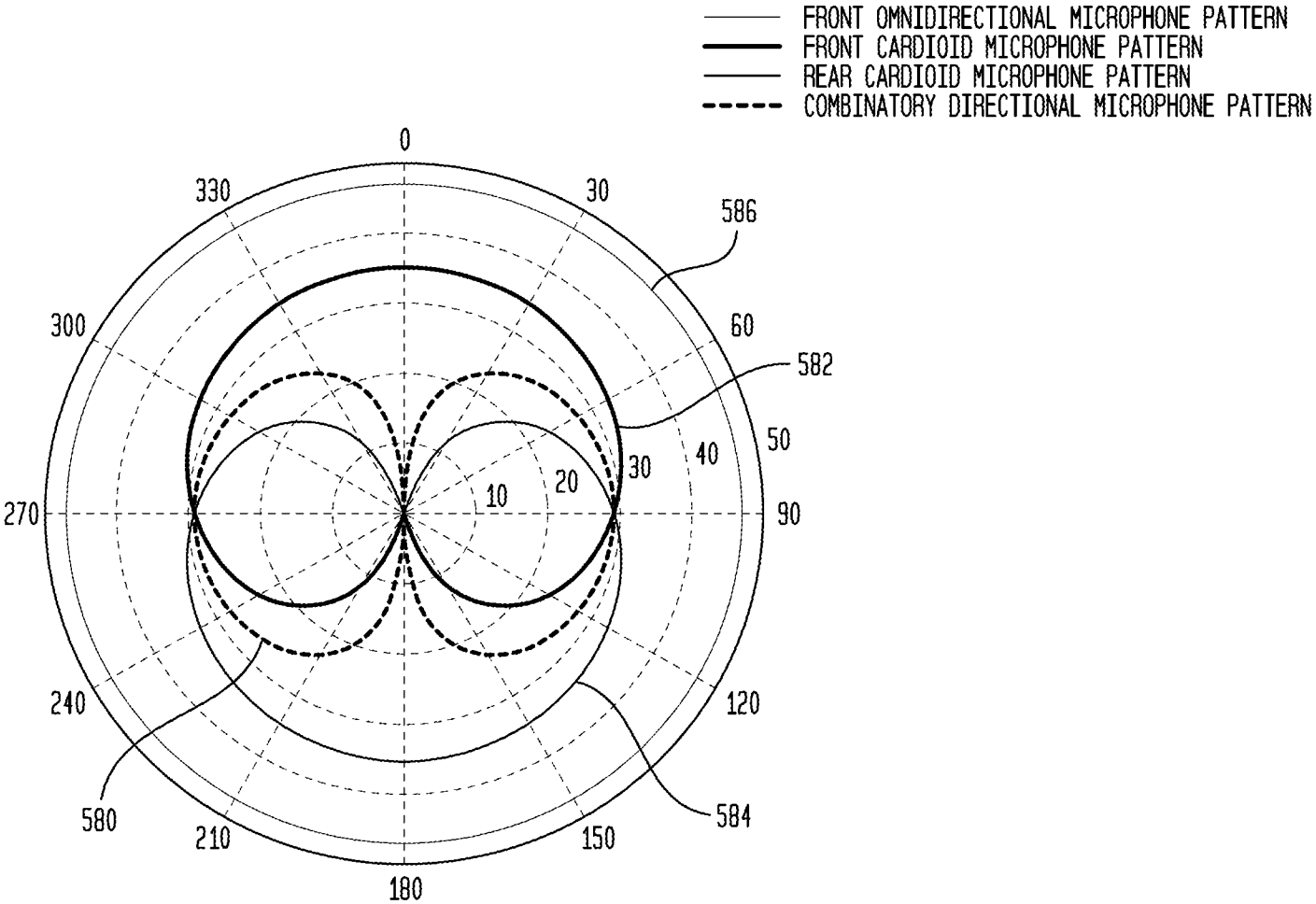
FIG. 5 is a polar plot illustrating a polar pattern associated with a combinatory directional microphone signal, in accordance with certain embodiments presented herein.

Referring first to FIG. 5, shown is a polar plot illustrating a polar pattern 580 associated with a combinatory directional microphone signal in accordance with certain embodiments presented herein. As such, the polar pattern 580 is referred to as a combinatory directional microphone pattern 580, and illustrates the directionality or pickup pattern of the associated combinatory directional microphone signal generated as described above (e.g., in a combinatory processing module, such as combinatory processing modules 435(A) or 435(B)).

In the example of FIG. 5, the combinatory directional microphone pattern 580 is generated, using the techniques described above with reference to FIG. 4A, from a front-facing cardioid microphone signal and a rear-facing cardioid microphone signal. The front-facing cardioid microphone signal and the rear-facing cardioid microphone signal may each be generated, for example, at a directional pre-processing module (e.g., module 431).

As shown in FIG. 5, the polar pattern associated with the front-facing cardioid microphone signal, referred to as front cardioid pattern 582, has a greatest sensitivity to the front of the recipient (i.e., at 0 degrees). Also as shown in FIG. 5, the polar pattern associated with the rear-facing cardioid microphone signal, referred to rear cardioid pattern 584, has a greatest sensitivity to the rear of the recipient (i.e., at 180 degrees). Also shown in FIG. 5 is a front omnidirectional pattern 586, which is associated with the raw omnidirectional output of the front microphone in a microphone array (e.g., corresponds to y1).

In the example of FIG. 5, use of the front-facing cardioid microphone signal and the rear-facing cardioid microphone signal to generate the combinatory directional microphone signal results in the combinatory directional microphone pattern 580 that has greatest sensitivity in opposing directions that are each substantially orthogonal to the microphone axis. That is, in FIG. 5, the combinatory directional microphone pattern 580 has greatest sensitivity at approximately ninety (90) degrees and approximately two-hundred and seventy (270) degrees. Stated differently, the combinatory directional microphone pattern 580 is a figure-infinity directionality pattern that is oriented substantially orthogonal to the microphone axis. As used herein, a "figure-infinity" pattern has the same general shape as a figure-8 directional microphone pattern, but with sensitivity to 90 and 270 degrees instead of 0 and 180 (hence the name figure-infinity, given the shape of the infinity symbol in contrast the number 8). In a cardioid analysis, it can be seen that the combinatory processing, in generating pattern 580, in effect, visually splits the single null of the front and rear cardioid patterns.

Figure 6:
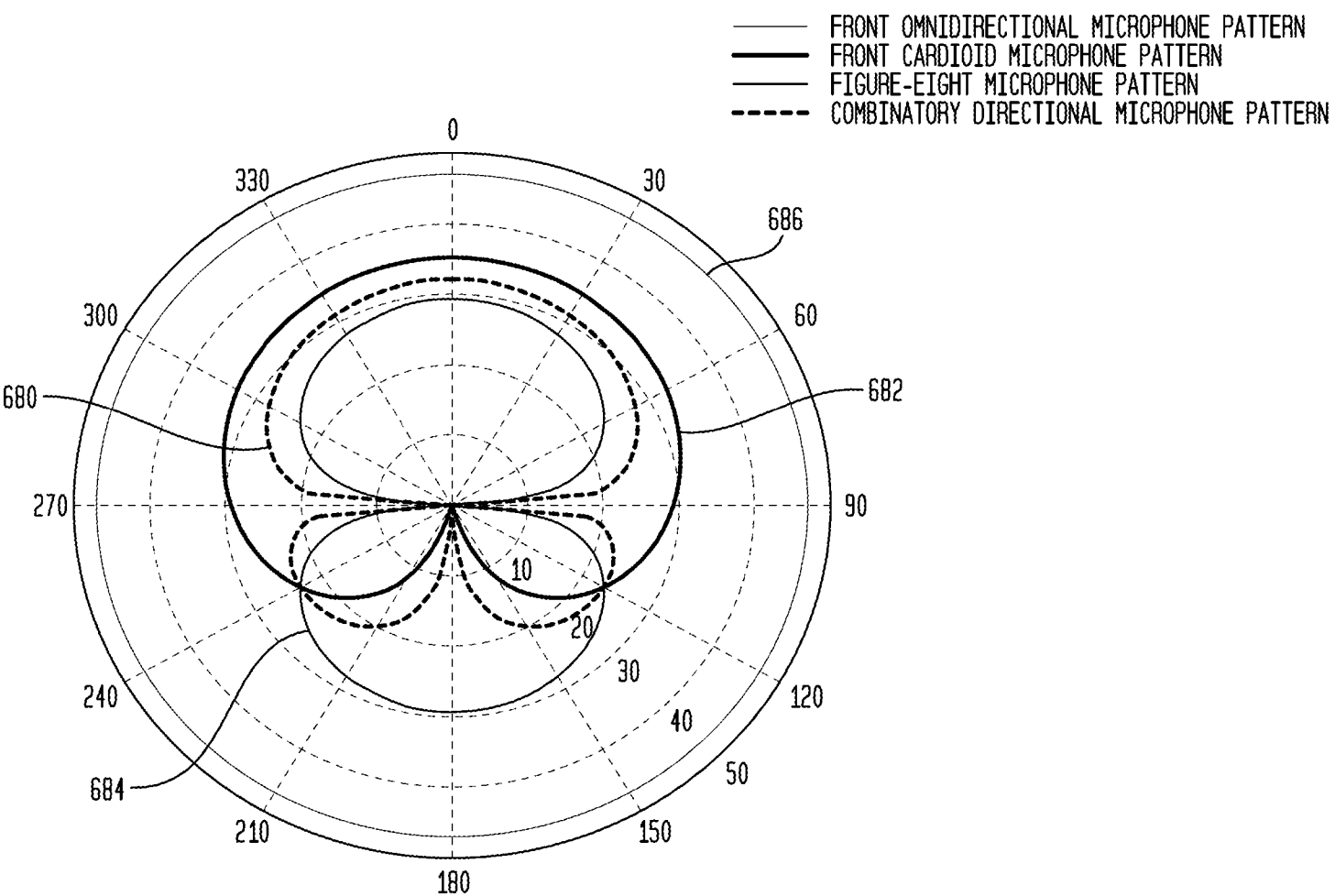
FIG. 6 is a polar plot illustrating a polar pattern associated with a combinatory directional microphone signal, in accordance with certain embodiments presented herein.

Referring next to FIG. 6, shown is a polar plot illustrating a polar pattern 680 associated with a combinatory directional microphone signal in accordance with certain embodiments presented herein. As such, the polar pattern 680 is referred to as a combinatory directional microphone pattern 680, and illustrates the directionality or pickup pattern of the associated combinatory directional microphone signal generated as described above (e.g., in a combinatory processing module, such as combinatory processing modules 435(A) or 435(B)).

In the example of FIG. 6, the combinatory directional microphone pattern 680 is generated, using the techniques described above with reference to FIG. 4A, from a front-facing cardioid microphone signal and a figure-8 (bidirectional) microphone signal. The front-facing cardioid microphone signal and the figure-8 microphone signal may each be generated, for example, at a directional pre-processing module (e.g., module 431).

As shown in FIG. 6, the polar pattern associated with the front-facing cardioid microphone signal, referred to as front cardioid pattern 682, has a greatest sensitivity to the front of the recipient (i.e., at 0 degrees). Also as shown in FIG. 6, the polar pattern associated with the figure-8 microphone signal, referred to as figure-8 or bidirectional pattern 684, has dual-sensitivity (i.e., to the front and back) along the microphone axis. Also shown in FIG. 6 is a front omnidirectional pattern 686, which is associated with the raw omnidirectional output of the front microphone in a microphone array (e.g., corresponds to y1).

In the example of FIG. 6, use of the front-facing cardioid microphone signal and the figure-8 microphone signal to generate the combinatory directional microphone signal results in the combinatory directional microphone pattern 680 that has a forward-facing microphone with two rear lobes. In a cardioid analysis, it can be seen that the pattern 680 is splitting the single null between two different locations, at 90 degrees and at 180 degrees. The effect is therefore analogous to sharing the null ability in a first order system between two locations through the process.

Figure 7:
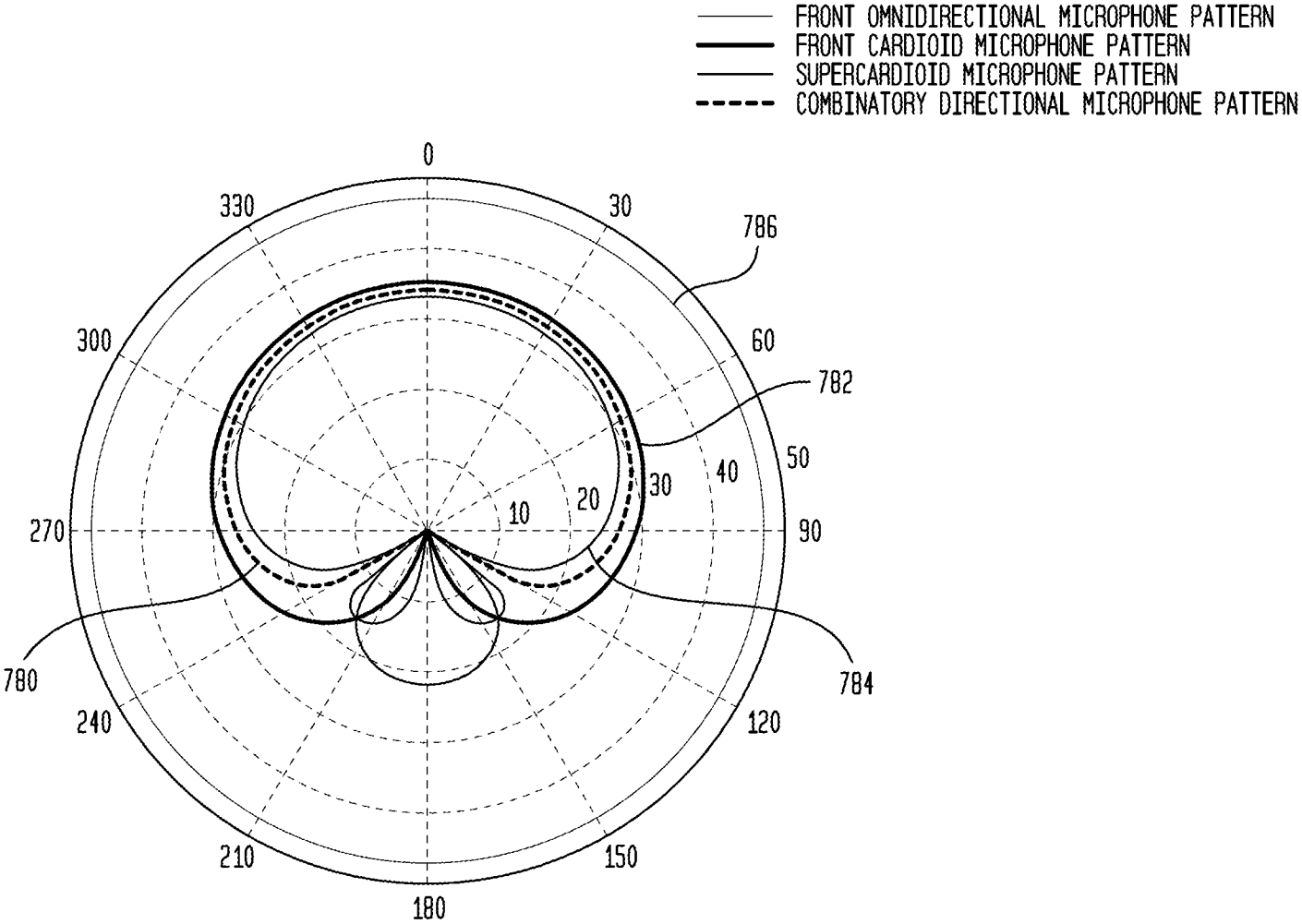
FIG. 7 is a polar plot illustrating a polar pattern associated with a combinatory directional microphone signal, in accordance with certain embodiments presented herein.

Referring next to FIG. 7, shown is a polar plot illustrating a polar pattern 780 associated with a combinatory directional microphone signal in accordance with certain embodiments presented herein. As such, the polar pattern 780 is referred to as a combinatory directional microphone pattern 780, and illustrates the directionality or pickup pattern of the associated combinatory directional microphone signal generated as described above (e.g., in a combinatory processing module, such as combinatory processing modules 435(A) or 435(B)).

In the example of FIG. 7, the combinatory directional microphone pattern 780 is generated, using the techniques described above with reference to FIG. 4A, from a front-facing cardioid microphone signal and a super cardioid microphone signal. The front-facing cardioid microphone signal and the super cardioid microphone signal may each be generated, for example, at a directional pre-processing module (e.g., module 431).

As shown in FIG. 7, the polar pattern associated with the front-facing cardioid microphone signal, referred to as front cardioid pattern 782, has a greatest sensitivity to the front of the recipient (i.e., at 0 degrees). Also as shown in FIG. 7, the polar pattern associated with the super cardioid microphone signal, referred to as super cardioid pattern 784, has is similar to the front-facing cardioid, but with a figure-8 contribution, leading to a tighter area of front sensitivity (i.e., at 0 degrees) and a small lobe of rear sensitivity (e.g., at 180 degrees). Also shown in FIG. 7 is a front omnidirectional pattern 786, which is associated with the raw omnidirectional output of the front microphone in a microphone array (e.g., corresponds to y1).

In the example of FIG. 7, use of the front-facing cardioid microphone signal and the super cardioid microphone signal to generate the combinatory directional microphone signal results in the combinatory directional microphone pattern 780 that has a forward-facing sensitivity with a dual-rear sensitivity. That is, as shown, the combinatory directional microphone pattern 780 has similar front directionality to the super cardioid pattern 784, but two rear lobes that are each offset from the microphone axis (i.e., as opposed to a single rear lobe in the super cardioid pattern). This pattern 780 could, for example, provide superior directional properties compared to standard first order directional microphones.

Referring next to FIG. 8, shown is a polar plot illustrating a polar pattern 880 associated with a combinatory directional microphone signal in accordance with certain embodiments presented herein. As such, the polar pattern 880 is referred to as a combinatory directional microphone pattern 880, and illustrates the directionality or pickup pattern of the associated combinatory directional microphone signal generated as described above (e.g., in a combinatory processing module, such as combinatory processing modules 435(A) or 435(B)).

In the example of FIG. 8, the combinatory directional microphone pattern 880 is generated, using the techniques described above with reference to FIG. 4A, from a front-facing cardioid microphone signal and a hyper cardioid microphone signal. The front-facing cardioid microphone signal and the hyper cardioid microphone signal may each be generated, for example, at a directional pre-processing module (e.g., module 431).

As shown in FIG. 8, the polar pattern associated with the front-facing cardioid microphone signal, referred to as front cardioid pattern 882, has a greatest sensitivity to the front of the recipient (i.e., at 0 degrees). Also as shown in FIG. 8, the polar pattern associated with the hyper cardioid microphone signal, referred to as hyper cardioid pattern 884, has is similar to the front-facing cardioid, but with a figure-8 contribution, leading to a tighter area of front sensitivity (i.e., at 0 degrees) and a small lobe of rear sensitivity (e.g., at 180 degrees). Relative to a supercardoid pattern, the hyper cardioid pattern 884 has greater rear sensitivity. Also shown in FIG. 8 is a front omnidirectional pattern 886, which is associated with the raw omnidirectional output of the front microphone in a microphone array (e.g., corresponds to y1).

In the example of FIG. 8, use of the front-facing cardioid microphone signal and the hyper cardioid microphone signal to generate the combinatory directional microphone signal results in the combinatory directional microphone pattern 880 that has a forward-facing sensitivity with a dual-rear sensitivity. That is, as shown, the combinatory directional microphone pattern 880 has similar front directionality to the hyper cardioid pattern 884, but two rear lobes that are each offset from the microphone axis (i.e., as opposed to a single rear lobe in the hyper cardioid pattern). Of note is that, in the rear lobes, there is a 90 degree signal change.

In certain aspects presented herein, the combinatory microphone techniques presented herein utilize the polarity change between a directional microphone signal and the square root property making negative numbers into imaginary numbers. Such embodiments create a directional microphone signal for part of the input directionality, and a sigmoidal driven noise cancelation process for the remainder of the input directionality. This results in an aperture-specific sinusoid-driven noise cancelation. A directional input basis decision can be made regarding which signals will be processed on a standard directional microphone basis, and which ones will have the addition of noise cancelation. The process changes the absolute calculation and only makes the real part of the signal, as shown below in Equation 8.

$$\varphi(t)=\mathrm{IFFT}(\mathrm{real}(\sqrt{\Phi\Phi_{CDM}(\omega,\vec{k})})) \qquad \text{Equation 8}$$

Figure 9:
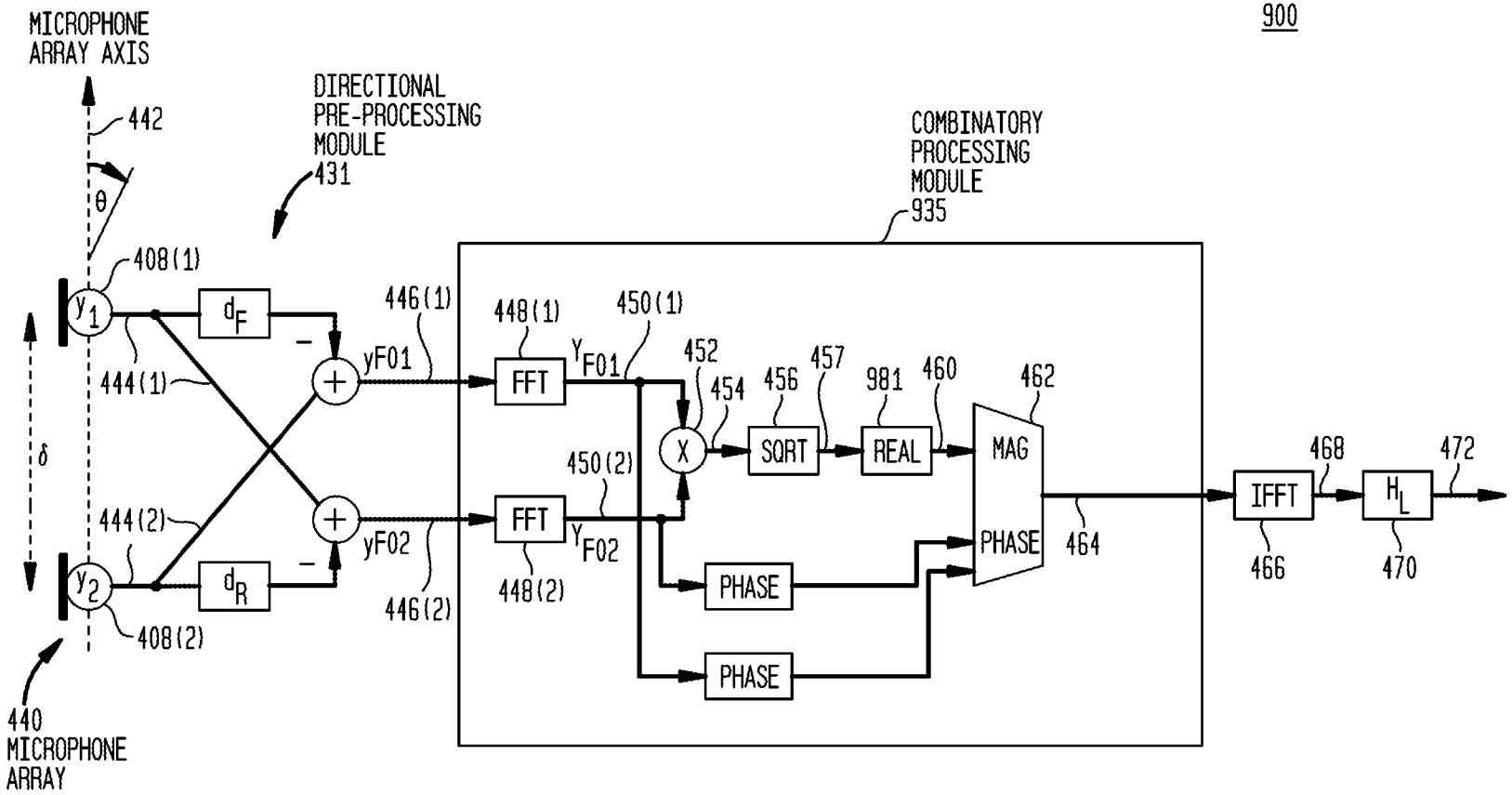
FIG. 9 is functional block diagram illustrating a portion of a device configured to generate a combinatory directional microphone signal, in accordance with certain embodiments presented herein.

FIG. 9 generally illustrates a portion of a device 900 (e.g., e.g., auditory prosthesis, mobile phone, laptop, headset, headphones etc.) configured to generate a combinatory directional microphone signal in accordance with Equation 8, above. More specifically, device 900 is similar to device 400(A) of FIG. 4A, in that it also comprises microphone array 440, directional pre-processing module 431, inverse Fourier transform block 466, and frequency filter 470. Device 900 also comprises a combinatory processing module 935, which is similar to combinatory processing module 435(A), except that, in FIG. 9, the processing block 458 (i.e., the absolute value block that calculates an absolute value of the intermediate signal 457), is replaced by processing block 981. More specifically, as explained above, a square root of the cross-power signal 454 is calculated at processing block 456 to generate an intermediate signal 457. In the example of FIG. 9, at block 981, any imaginary parts of the intermediate signal 457 are removed by computing the real part of the intermediate signal 457 (as in Equation 8, above). The result is conversion of the intermediate signal 457 into an amplitude domain signal 460.

Figure 10:
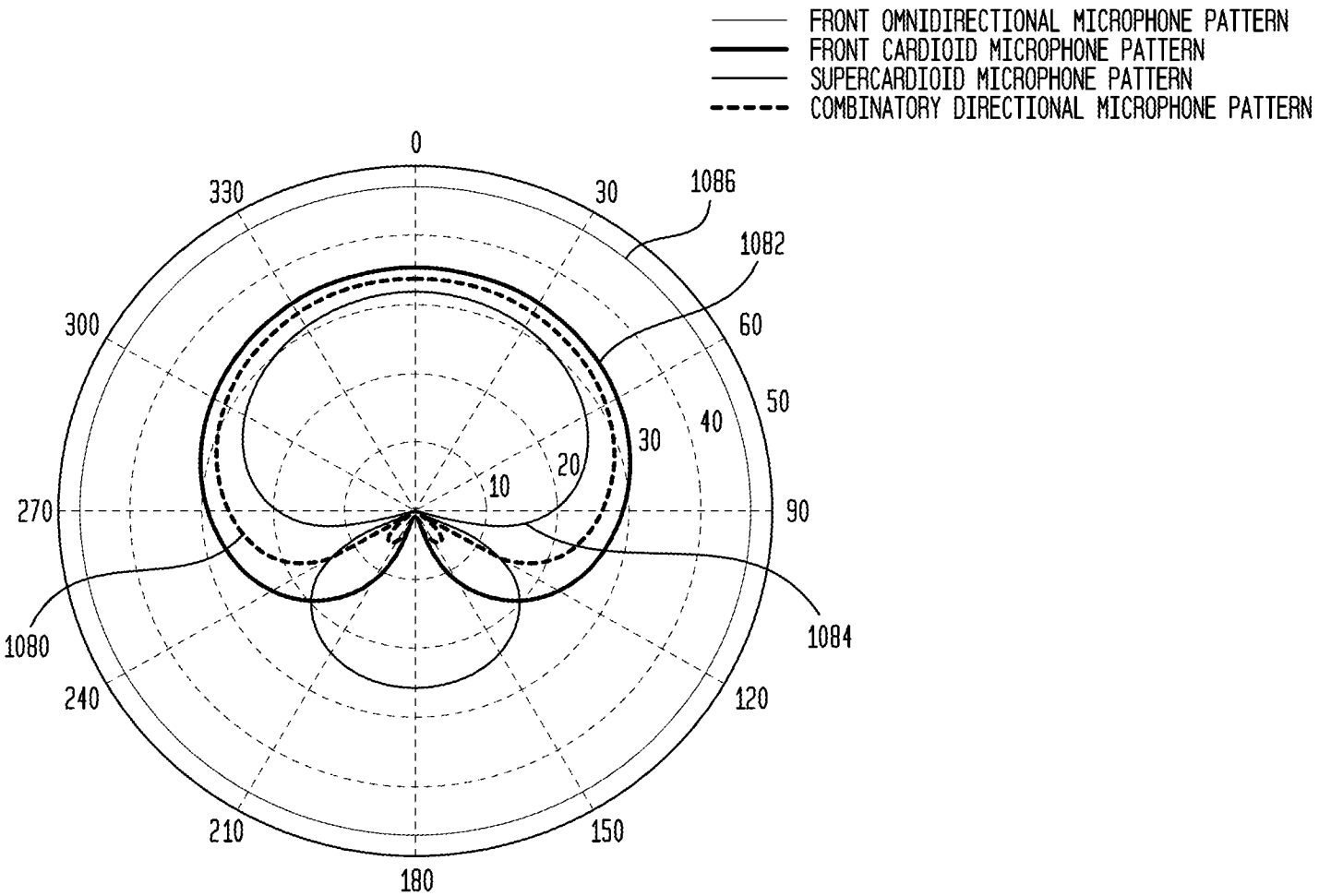
FIG. 10 is a polar plot illustrating a polar pattern associated with a combinatory directional microphone signal, in accordance with certain embodiments presented herein.

FIG. 10 illustrates an example of an aperture-specific, sinusoidal driven, combinatory directional microphone signal generated, in accordance with Equation 8 and FIG. 9, from a front-facing cardioid and a super cardioid. More specifically, FIG. 10 illustrates a polar pattern 1080 associated with a combinatory directional microphone signal in accordance with certain embodiments presented herein. As such, the polar pattern 1080 is referred to as a combinatory directional microphone pattern 1080, and illustrates the directionality or pickup pattern of the associated combinatory directional microphone signal generated as described above (e.g., in a combinatory processing module, such as combinatory processing modules 435(A) or 435(B)).

As noted, in the example of FIG. 10, the combinatory directional microphone pattern 1080 is generated, using the techniques described above with reference to FIG. 4A, from a front-facing cardioid microphone signal and a super cardioid microphone signal. The front-facing cardioid microphone signal and the super cardioid microphone signal may each be generated, for example, at a directional pre-processing module (e.g., module 431).

As shown in FIG. 10, the polar pattern associated with the front-facing cardioid microphone signal is referred to as front cardioid pattern 1082, while the polar pattern associated with the super cardioid microphone signal is referred to as super cardioid pattern 1084. Also shown in FIG. 10 is a front omnidirectional pattern 1086, which is associated with the raw omnidirectional output of the front microphone in a microphone array (e.g., corresponds to y1).

In the example of FIG. 10, use of the front-facing cardioid microphone signal and the super cardioid microphone signal to generate the combinatory directional microphone signal results in the combinatory directional microphone pattern 1080 that has a forward-facing sensitivity with a minor dual-rear sensitivity. That is, as shown, the combinatory directional microphone pattern 1080 has similar front directionality to the super cardioid pattern 1084, is very forward focused, but from 120 degrees to 240 degrees the noise cancelation heavily removes any signal. This pattern 1080 is a hybrid between combinatory directional microphone signals in the front angles, and a form of direction or arrival driven noise cancellation in the rear angles.

Figure 11:
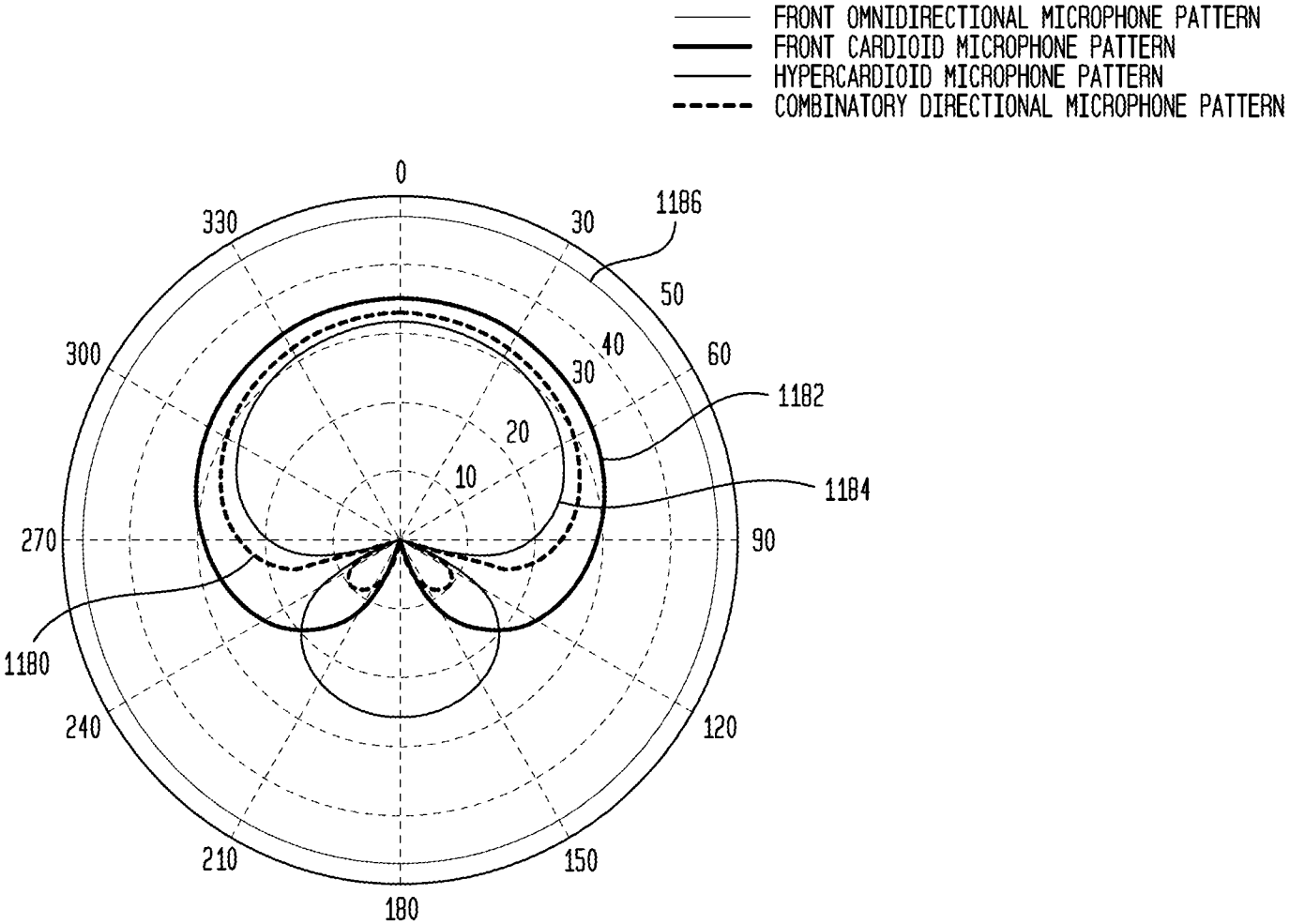
FIG. 11 is a polar plot illustrating a polar pattern associated with a combinatory directional microphone signal, in accordance with certain embodiments presented herein.

FIG. 11 illustrates another example of an aperture-specific, sinusoidal driven, combinatory directional microphone signal generated, in accordance with Equation 8 and FIG. 9, from a front-facing cardioid and a hyper cardioid. More specifically, FIG. 11 illustrates a polar pattern 1180 associated with a combinatory directional microphone signal in accordance with certain embodiments presented herein. As such, the polar pattern 1180 is referred to as a combinatory directional microphone pattern 1180, and illustrates the directionality or pickup pattern of the associated combinatory directional microphone signal generated as described above (e.g., in a combinatory processing module, such as combinatory processing modules 435(A) or 435(B)).

As noted, in the example of FIG. 11, the combinatory directional microphone pattern 1180 is generated, using the techniques described above with reference to FIG. 4A, from a front-facing cardioid microphone signal and a hyper cardioid microphone signal. The front-facing cardioid microphone signal and the hyper cardioid microphone signal may each be generated, for example, at a directional pre-processing module (e.g., module 431).

As shown in FIG. 11, the polar pattern associated with the front-facing cardioid microphone signal is referred to as front cardioid pattern 1182, while the polar pattern associated with the hyper cardioid microphone signal is referred to as hyper cardioid pattern 1184. Also shown in FIG. 11 is a front omnidirectional pattern 1186, which is associated with the raw omnidirectional output of the front microphone in a microphone array (e.g., corresponds to y1).

In the example of FIG. 11, use of the front-facing cardioid microphone signal and the hyper cardioid microphone signal to generate the combinatory directional microphone signal results in the combinatory directional microphone pattern 1180 that has a forward-facing sensitivity with a minor dual-rear sensitivity. That is, as shown, the combinatory directional microphone pattern 1180 has similar front directionality to the hyper cardioid pattern 1184, is very forward focused, but from 120 degrees to 240 degrees the noise cancelation heavily removes any signal. This pattern 1180 is a hybrid between combinatory directional microphone signals in the front angles, and a form of direction or arrival driven noise cancellation in the rear angles. Relative to the example of FIG. 10 (i.e., front with super cardioid), the example of FIG. 11 (i.e., front with hyper cardioid) is more forward directional, with a slight increase in the rear lobes. The aperture of noise cancelation is also wider in this implementation of FIG. 11, relative to that of FIG. 10.

It should be noted that the aperture specific noise reduction may be determined in other ways and the phase reversal of a signal may also be dealt with in other ways than presented in FIG. 9. For instance, the output for positive signals may be processed with an absolute operator, where negative signals may be set to 0.

It is to be appreciated that the techniques presented herein could be used in an iterative process where one or more combinatory directional microphone signals are used at the inputs to the combinatory processing (e.g., as the directional signal inputs to a combinatory processing module). For example, FIG. 12 illustrates an example in which two combinatory directional microphones could be used to share four quarter nulls over four locations.

Figure 12:
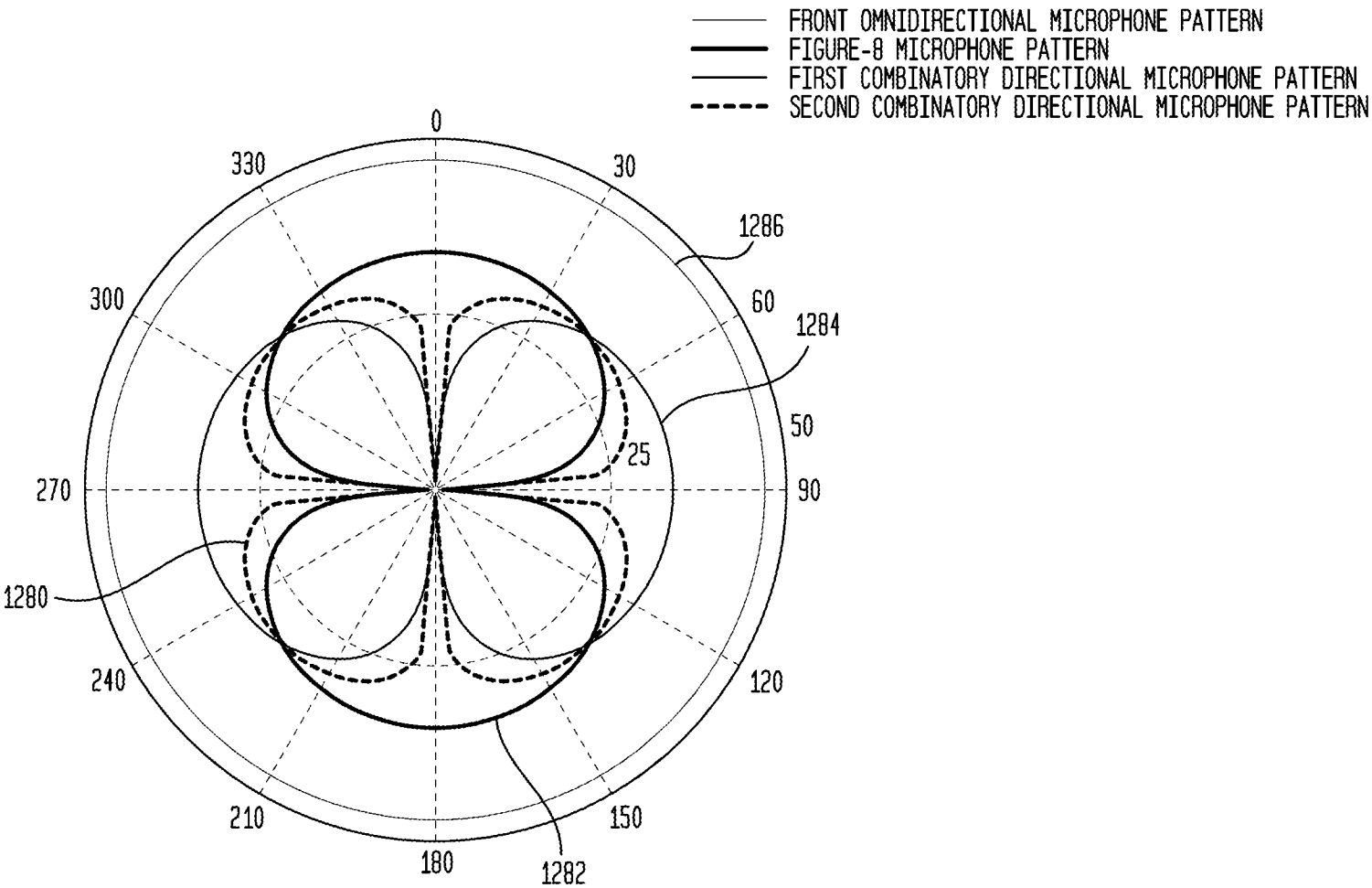
FIG. 12 is a polar plot illustrating a polar pattern associated with a combinatory directional microphone signal, in accordance with certain embodiments presented herein.

More specifically, FIG. 12 illustrates a polar pattern 1280 associated with a combinatory directional microphone signal generated, using the techniques described above with reference to FIG. 4A, from a first order figure-8 microphone signal and a figure-infinity combinatory directional microphone signal. The first order figure-8 microphone signal may be generated, for example, at a directional pre-processing module (e.g., module 431). The figure-infinity combinatory directional microphone signal may generated by a preliminary combinatory processing module (e.g., modules 435(A), 435(B), etc.).

As shown in FIG. 12, the polar pattern associated with the figure-8 cardioid microphone signal is referred to as figure-8 cardioid pattern 1282, while the polar pattern associated with the figure-infinity combinatory directional microphone signal is referred to as first combinatory directional microphone pattern (figure-infinity combinatory directional pattern) 1284. Also shown in FIG. 12 is a front omnidirectional pattern 1286, which is associated with the raw omnidirectional output of the front microphone in a microphone array (e.g., corresponds to y1).

In accordance with certain embodiments presented herein, a very strong directional microphone signal can be created through "power" combinatory processing techniques, s shown below in Equation 9.

$$\varphi(t)=\mathrm{IFFT}(|\Phi\Phi_{CDM}(\omega,k)|) \qquad \text{Equation 9}$$

In Equation 9, unlike the above examples which have amplitude domain outputs and normal acoustic signal loudness growth and generally have no speech distortion, this class would have a different loudness growth and some similar distortions to noise reduction processing, but would have enhanced directionality. A simple example is a power combinatory directional microphone with inputs as two front-facing cardioids. This gives a cardioid with the same pattern as a second order directional microphone, but with some noise and speech distortion similar to noise reduction.

Figure 13:
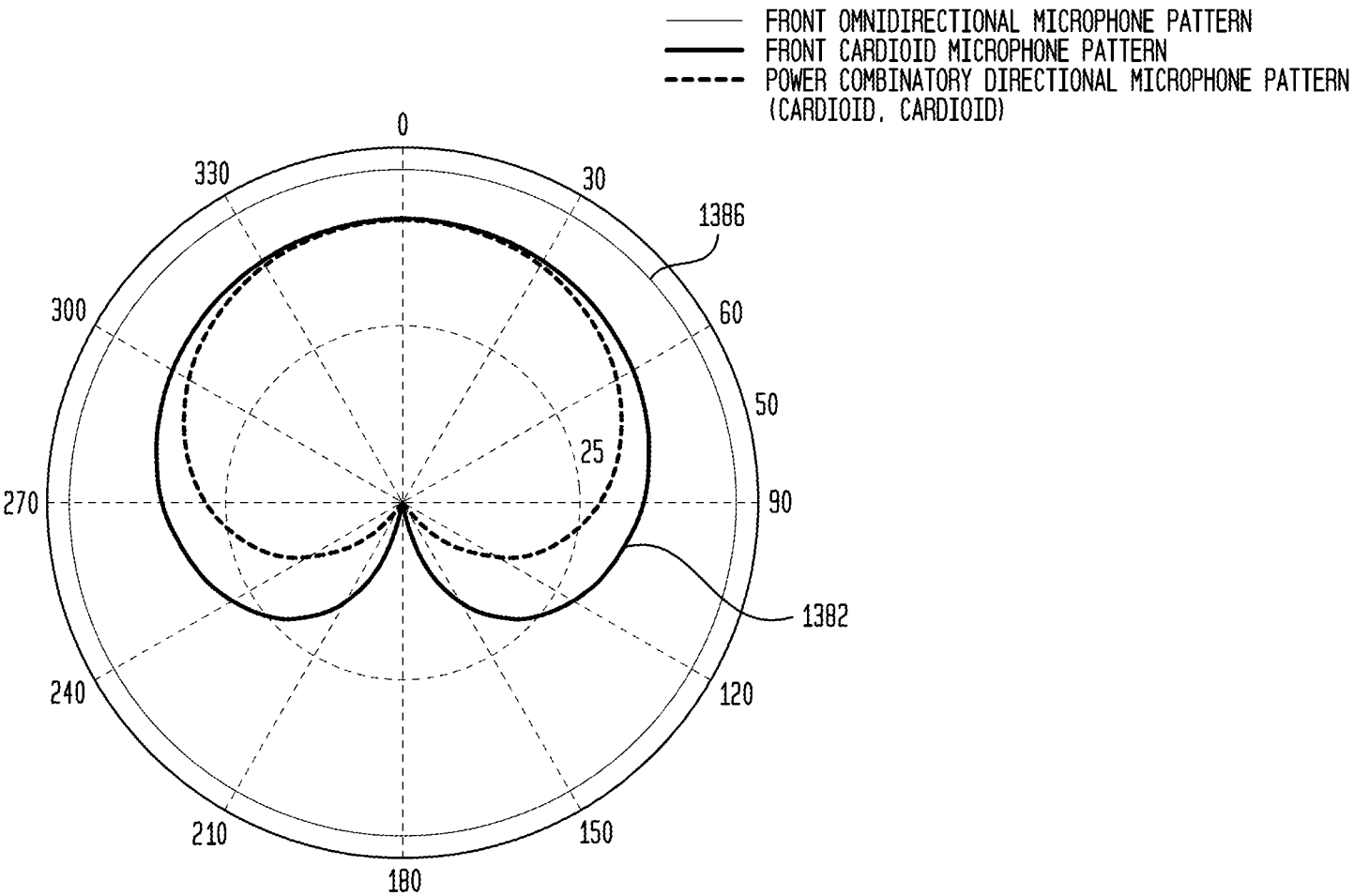
FIG. 13 is a polar plot illustrating a polar pattern associated with a combinatory directional microphone signal, in accordance with certain embodiments presented herein.

For example, as shown in FIG. 13, a polar pattern associated with the front-facing cardioid microphone signal is referred to as front cardioid pattern 1382 and a front omnidirectional pattern 1186, which is associated with the raw omnidirectional output of the front microphone in a microphone array (e.g., corresponds to y1). FIG. 13 also illustrates pattern 1380 associated with a power combinatory directional microphone signal generated, using the techniques described above with reference to Equation 9.

Figure 14:
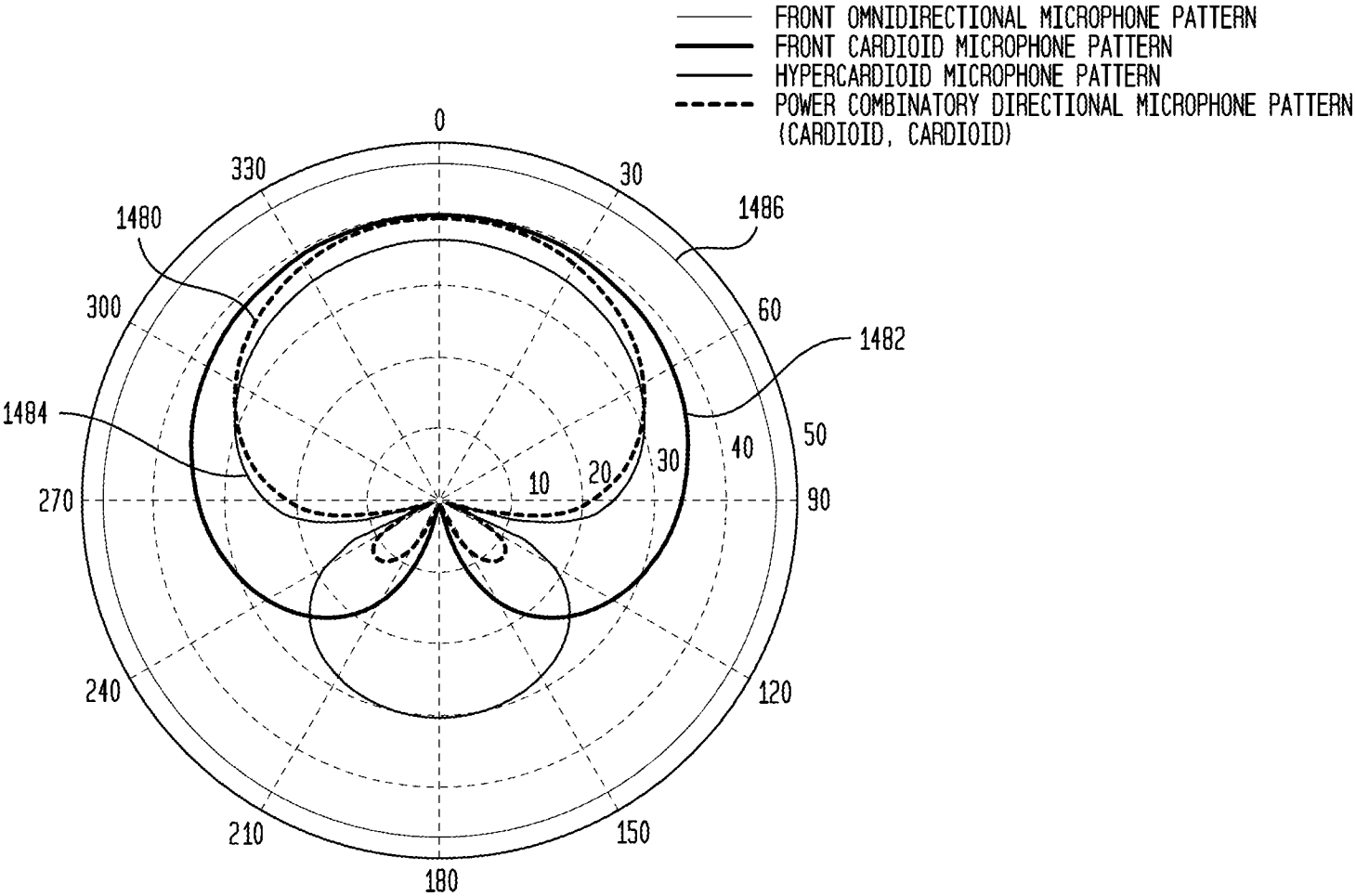
FIG. 14 is a polar plot illustrating a polar pattern associated with a combinatory directional microphone signal, in accordance with certain embodiments presented herein.

Additionally FIG. 14 illustrates a power combinatory microphone signal generated from a front-facing cardioid signal and a hyper cardioid signal, which almost only has signals from the front half. More specifically, shown in FIG. 14 is a polar pattern 1480 associated with a combinatory directional microphone signal generated, using the techniques described above with reference to Equation 9, from a front-facing cardioid signal and a hyper cardioid signal. As shown in FIG. 14, the polar pattern associated with the front-facing cardioid signal is referred to as front cardioid pattern 1482, while the polar pattern associated with the hyper cardioid signal is referred to as hyper cardioid microphone pattern 1484. Also shown in FIG. 14 is a front omnidirectional pattern 1486, which is associated with the raw omnidirectional output of the front microphone in a microphone array (e.g., corresponds to y1).

It is important to note that, for power combinatory directional microphones, the phase information will be calculated to minimize any audible distortions. Additionally, it would be expected that a gain control system would be utilized to present short time power combinatory microphone signals at longer time amplitude signal levels.

While magnitude combinatory directional microphones are able to maintain normal signal loudness, and power combinatory directional microphones provide enhanced directionality, a range of implementations between these two are possible. In certain embodiments, a magnitude combinatory directional microphone uses a square root 456 to convert the signal into the magnitude domain. A square root is the same as an exponent of a half (0.5), and leaving the signal in the power domain is the same as an exponent of one (1). A range of implementations are possible with functional exponents between, but not including 0.5 and 1, at 456 is possible, which would have share characteristics between maintaining normal loudness and enhanced directionality. In fact, even exponents outside this range may be used, such as 0.4, 1.1, and 2 are possible.

It is to be appreciated that the above polar plots of FIGS. 5-8 and 10-14 illustrate patterns in accordance with idealized (free-field) conditions (e.g., patterns while the microphones are not in proximity to an objects recipient's head). However, as noted above, the techniques presented herein may be implemented, for example in a hearing prosthesis that is worn on the head of a recipient. As such, in practice, the various polar patterns shown in FIGS. 5-8 and 10-14 will be affected by the presence of the recipient's head adjacent to the microphones, commonly known as the head-shadow effect. For example, with an auditory prosthesis, the prosthesis (and thus the microphones) may be positioned on, for example, the right side of the recipient's head when in use. In such an example, the microphone polar patterns for the right half (i.e., between 0 and 180 degrees) will look similar to the idealized patterns shown in FIGS. 5-8 and 10-14, but the left half (i.e., between 180 and 0 degrees) will look quite different. In particular, the polar patterns will, in practice, each, have reduced sensitivity to the spatial regions on the left (opposite) side of the head. The practical effect is that the combinatory processing techniques presented herein increase sensitivity to sounds received on the same side of the head as which the hearing prosthesis is located/worn.

For those skilled in the art, it will be evident these processes can be carried out in the time domain or in the frequency domain. Although the process has been described above for the combinatory directional microphone module 435(*a*) and 435(*b*) in the frequency domain, they could similarly be implemented in the time domain. For instance, convolution theorem states that element wise multiplication in the frequency domain (as described in 435(*a*) and 435(*b*)) is equivalent to convolution in the time domain. Similarly, element wise multiplication in the frequency domain with the complex conjugate of one signal is the same as cross-correlation in the time domain as described by cross-correlation theorem. It is also intended in this description to describe the use of elementwise multiplication of frequency domain signals being either their frequency domain representation or the complex conjugate of their frequency domain representation, which may have advantageous properties under some circumstances. Similarly, for those skilled in the art, convolution represents a range of convolutions such as linear or circular, and similarly FFT also represents a range of FFT transforms as described including with and without zero padding.

Figure 15:
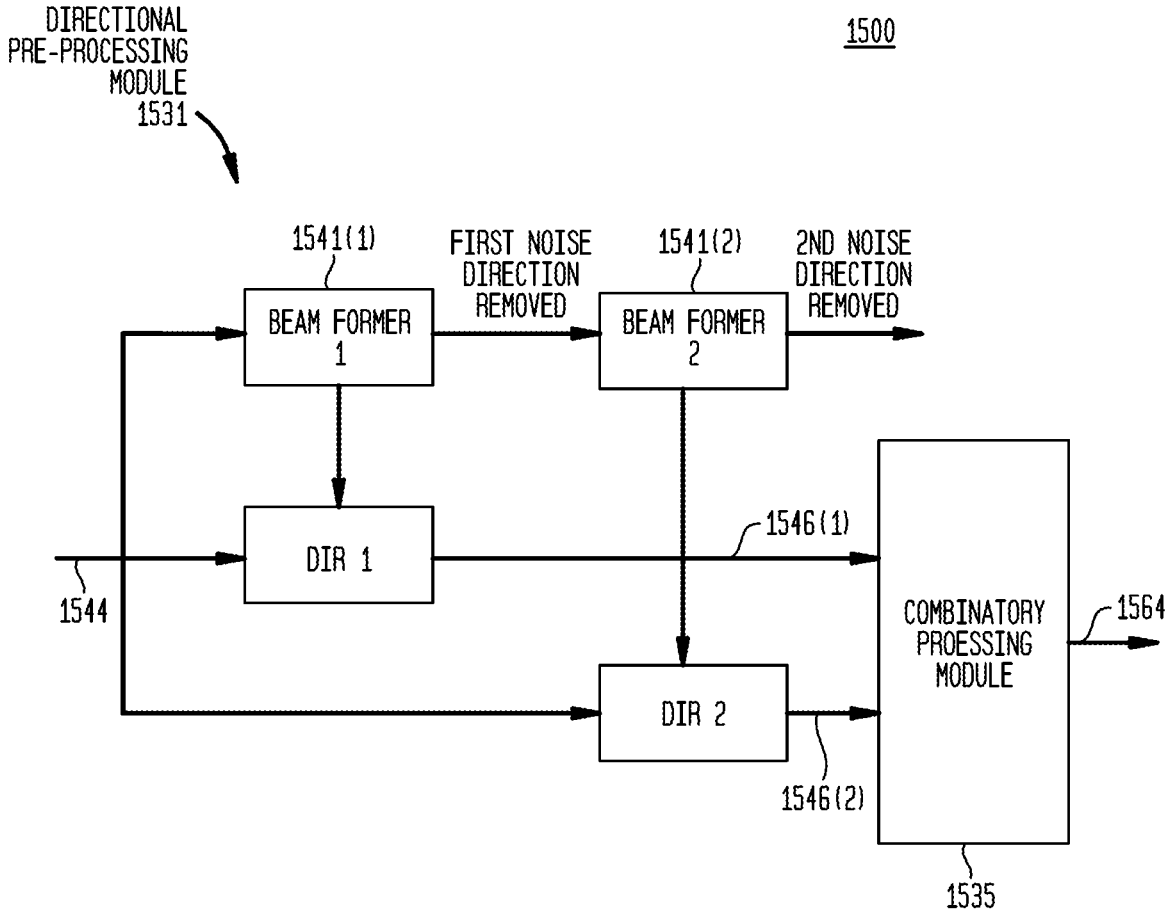
FIG. 15 is functional block diagram illustrating a portion of a device configured to generate a combinatory directional microphone signal, in accordance with certain embodiments presented herein.

There is a class of first order directional microphones, known as adaptive beamformers, which are able to steer their null depending on the location of the noise. In the same way that adaptive beamformers are able to steer their single null to the direction of the largest noise location, a system using the combinatory microphone techniques presented herein may steer two half nulls from the input directional microphone signals to maximally reduce the noise. For example, shown in FIG. 15, shown is a portion of a device 1500 (e.g., auditory prosthesis, mobile phone, laptop, headset, headphones etc.) that includes a directional pre-processing module 1531 and a combinatory processing module 1535. The combinatory processing module 1535 may be implemented similar one of the embodiments of FIGS. 4A, 4B, or FIG. 9 and is configured to generate a combinatory directional microphone signal 1564 from two directional microphone signals 1546(1) and 1546(2).

The directional pre-processing module 1531 is configured to generate the directional microphone signals 1546(1) and 1546(2) for processing by the combinatory processing module 1535 from microphone signals 1544 captured by a microphone array (not shown in FIG. 15). In the example of FIG. 15, the directional pre-processing module 1531 comprises two adaptive beamformers 1541(1) and 1541(2). As a result of the two adaptive beamformers 1541(1) and 1541(2), which each remove noise from different directions, the directional microphone signals 1546(1) and 1546(2) will point to different noises or areas, so that there is two independent inputs into the combinatory processing module 1535 (i.e., ensures that the two directional signals are not directed to the same point/target).

While the use of adaptive beamformers and even multiple beamformers as inputs into a combinatory processing module are able to steer the direction of the null, they may not, in certain examples, be able to steer the direction of the most sensitive direction. In the typical close spaced arrangements, the most sensitive direction is at zero (0) degrees and one hundred and eighty (180) degrees. A combinatory directional microphone signal producing the figure-infinity signal is not most sensitive to zero (0) or one hundred and eighty (180) degrees. With the use of a combinatory directional microphone signal such as that which produces the figure-infinity polar pattern (pattern 580 in FIG. 5), or generally with sensitivity substantially orthogonal to the microphone axis, a full range of most sensitive listening directions is possible. This can be achieved using a combinatory directional processing module with inputs such as a figure-infinity signal and a forward-facing signal and a forward facing directional microphone signal. This may also be achieved by simple mixing of the two microphone signals. But changing the inputs (where at least one of the inputs is not zero (0) or one hundred and eighty (180) degrees sensitive), either into a combinatory processing module or by mixing, the most sensitive direction can be changed. For hearing aids, this provides an adaptive listening direction, which can be steered to any direction.

Figure 16:
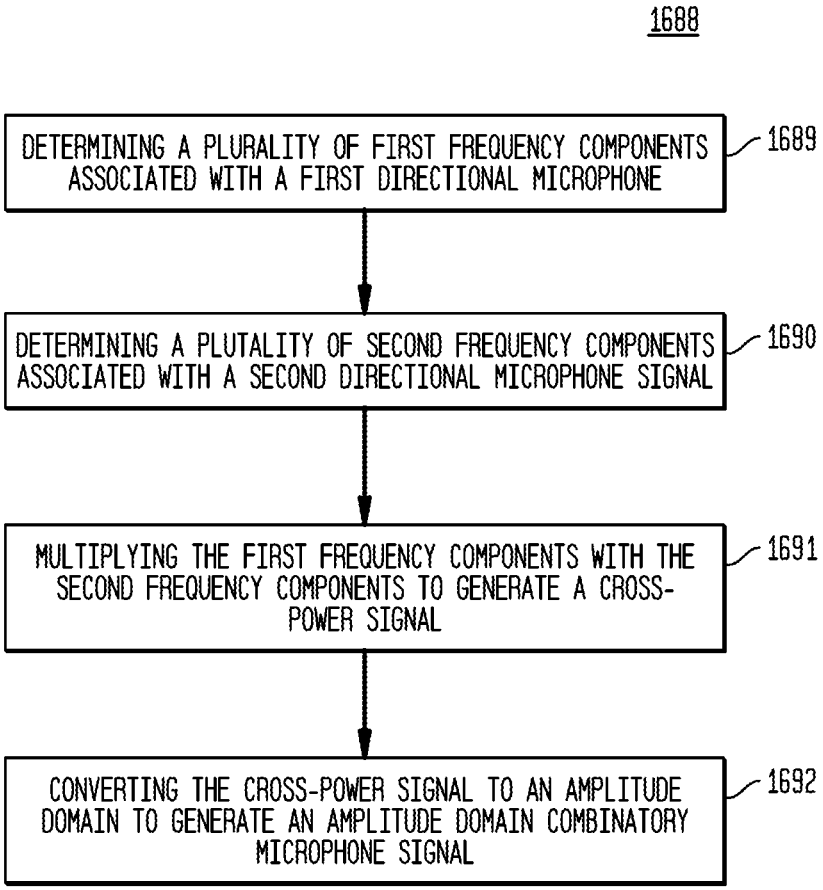
FIG. 16 is a flowchart of a method in accordance with certain embodiments presented herein.

FIG. 16 is a flowchart of a method 1688, in accordance with certain embodiments presented herein. Method 1688 begins at 1689 where a plurality of first frequency components associated with a first directional microphone signal are determined. At 1690, a plurality of second frequency components associated with a second directional microphone signal are determined. At 1691, the first frequency components are multiplied with the second frequency components to generate a cross-power signal. At 1692, the cross-power signal is converted to an amplitude domain to generate an amplitude domain combinatory microphone signal. In certain embodiments, a phase of the amplitude domain combinatory microphone signal may reconstructed from a phase signal.

Figure 17:
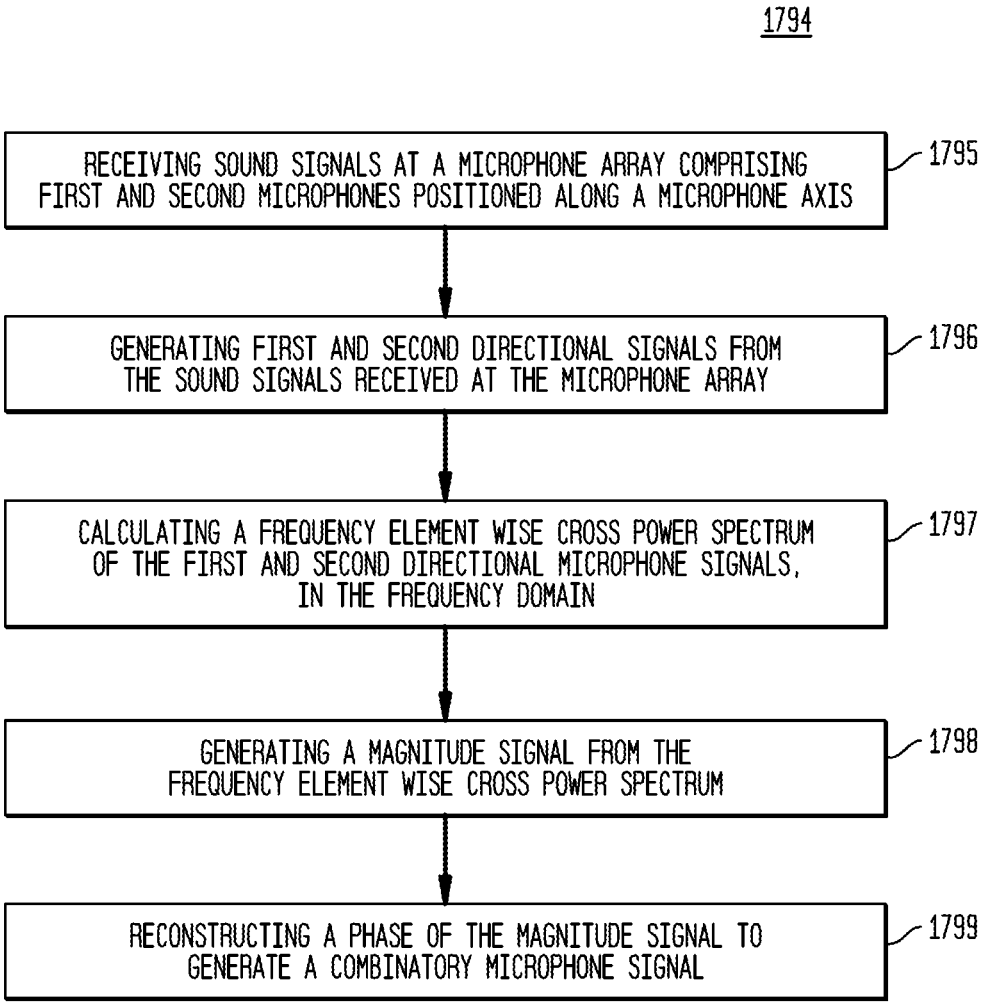
FIG. 17 is a flowchart of another method in accordance with certain embodiments presented herein.

FIG. 17 is a flowchart of a method 1794, in accordance with certain embodiments presented herein. Method 1794 begins at 1795 where sound signals are received at a microphone array comprising first and second microphones positioned along a microphone axis. At 1796, first and second directional signals are generated from the sound signals received at the microphone array. At 1797, a frequency element wise cross power spectrum of the first and second directional microphone signals is computed in the frequency domain. At 1798, a magnitude signal is generated from the frequency element wise cross power spectrum and, at 1799, a phase of the magnitude signal is reconstructed to generate a combinatory microphone signal. In certain embodiments, the combinatory microphone signal is associated with a microphone pickup pattern that has at least one area of broad-side sensitivity.

While adaptive beamformers and adaptive listening direction are able to steer their null depending on the noise location or steer their most sensitive direction respectively, both are typically implemented on a single close spaced microphone array. There are other automation systems which use multiple close spaced inputs to determine the systems operations. These systems typically consist of sound feature extraction, environmental classification, and then technology selection. In an automation with multiple inputs, with one being a close spaced array, the system (using at least one close spaced array) determine the type of listening environment or direction of main source and/or determine appropriate technologies to use in that listening environment.

For hearing aids, two hearing aids are often worn and wirelessly share information, creating a multiple close spaced array system with two close spaced arrays (one on each ear). Combinatory microphone signals from one or both close spaced arrays could monitor signals from specific directions. For instance, a figure-infinity combinatory microphone signal may be used to monitor the auditory scene from both sides of the listener. Another example is where a combinatory microphone signal, such as 880 in FIG. 8, is used to monitor signals from one direction in the left ear, a further combinatory microphone signal, such as 580 in FIG. 5, is used to monitor signals from another direction in the left ear, and a third combinatory microphone signal, such as signal 580, is used to monitor signals from another direction in the right ear. Any number of directional microphone signals, omnidirectional microphone signals, with the addition of a combinatory directional microphone signal in a system may be used to monitor signals from a range of directions to assess the listening environment. This is a representation of a combinatory directional microphone scene classification system.

For other systems such as cochlear implants, mobile phones and computers, combinatory microphone signals from at least one close spaced array in the system could be used to monitor signals from a range of directions to assess the listening environment.

In any combinatory directional microphone monitoring and classification system, specific signals may be selected to represent the environment or specific technologies may be applied to the signals or selection of signals to improve the signal. The signal of interest may use one or more signals from the monitored signals in the auditory scene classification process, or other signals not used in the auditory scene classification process. The monitoring system may also be used to adapt the null direction in the case of a directional microphone system, or the most sensitive direction in the case of an adaptive listening direction system.

For hearing aids and other hearing devices, a hearing device on each ear is often worn, providing information to both ears, and are often linked wirelessly. These systems can provide important information about the sound environment contained in the interaural timing difference (ITD) or interaural level difference (ILD). The ITD and ILD are important in providing the listener information regarding the location or direction of sounds. In some cases due to the microphone locations or due to the processing of the signal or due to the presentation of the signal to the listener, the original timing or loudness of the signal may be changed, obscured or lost.

Combinatory directional microphones with greatest sensitivity substantially orthogonal to the microphone axis would provide improved sensitivity to each side of the listener, particularly when worn on the head. This would provide improvements segregation of signals at both ears compared to a range of directional microphones including forward facing directional microphone patterns and omnidirectional microphone patterns. The greater segregation of signals between the two ears with the use of combinatory directional microphones could be used advantageously in improving ITDs and ILDs.

One way to improve ITDs and/or ILDs is to use off-axis combinatory directional microphones to process signals for each ear. Another way to improve ITDs and/or ILDs is to use off-axis signal processing to enhance would be to process the signal on each ear independently to enhance the timing or level attributes of the signal. This may be done with processing any number of directional microphone signals obtained from one ear. For instance, processing an omnidirectional microphone signal and an off-axis microphones signal together to enhance the level of timing information in the signal. A third method would be to share information regarding the signal in each ear with the other ears signals to enhance the timing or level presented to one or both ears.

Figure 18:
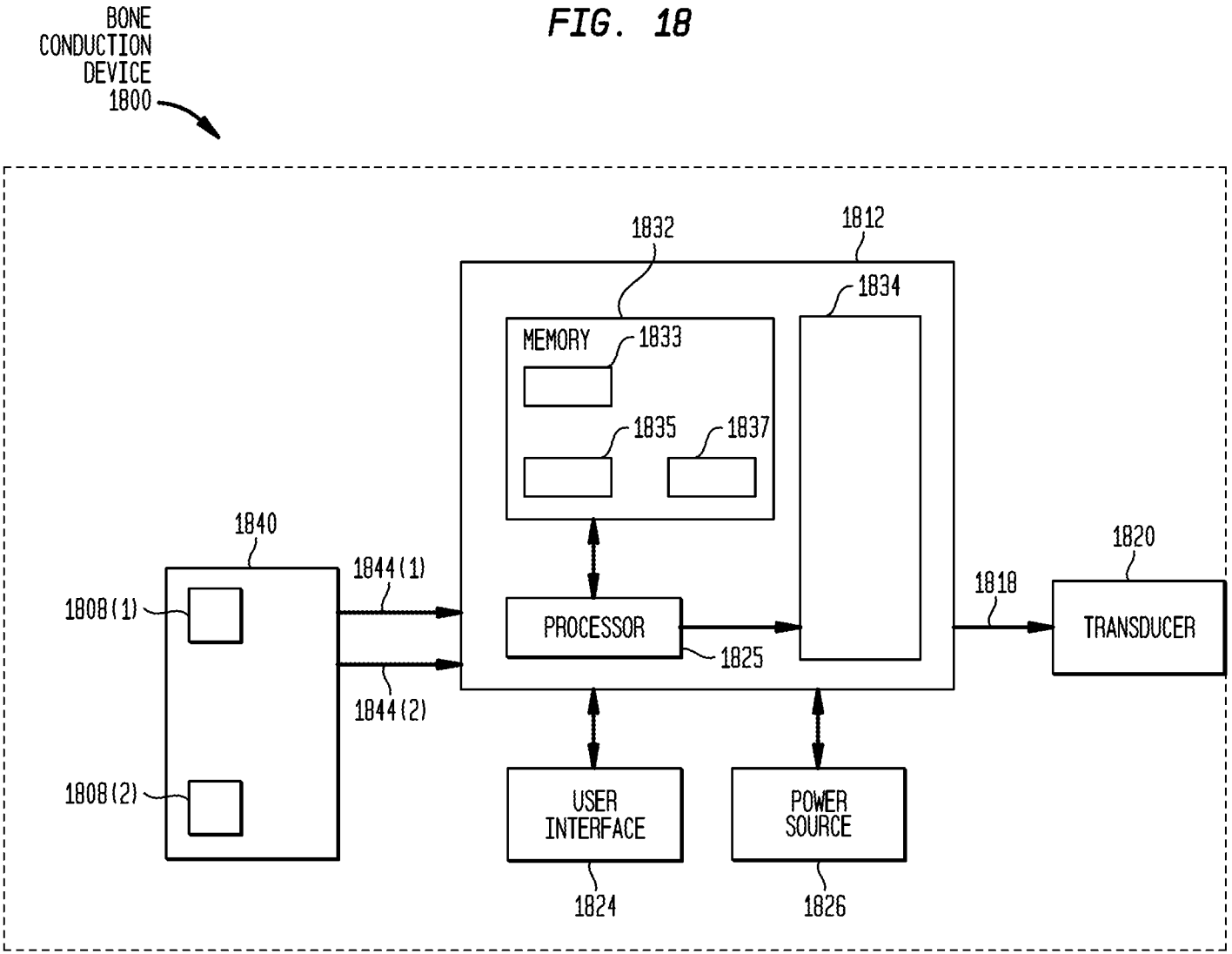
FIG. 18 is a functional block diagram of one example arrangement for a bone conduction device configured to implement embodiments presented herein.

As noted above, the techniques presented herein may be implemented in a number of different devices that include a plurality of microphones, such as laptops, mobile phones, headsets, auditory prosthesis, etc. For example, with in one illustrative auditory prosthesis scenario, the techniques presented herein could be used to enable a recipient to hear a person seated next to them (e.g., in a car). In another example, an automation system may use the techniques presented herein to determine the location of noise. In yet another example, a chip manufacturer could use the techniques presented herein to make their MEMS microphone system with multiple independent microphones point is a specific direction. FIG. 18, in particular, is a functional block diagram of one example arrangement for a bone conduction device 1800 configured to implement embodiments presented herein. As shown, bone conduction device 1800 is positioned at (e.g., behind) the ear of a recipient. The bone conduction device 1800 comprises a microphone array 1840, an electronics module 1812, a transducer 1820, a user interface 1824, and a power source 1826.

The microphone array 1840 comprises first and second microphones 1808(1) and 1808(2) configured to convert received sound signals (sounds) into microphone signals 1844(1) and 1844(2). The microphone signals 1844(1) and 1844(2) are provided to electronics module 1812. In general, electronics module 1812 is configured to convert the microphone signals 1844(1) and 1844(2) into one or more transducer drive signals 1818 that activate transducer 1820. More specifically, electronics module 1812 includes, among other elements, at least one processor 1825, a memory 1832, and transducer drive components 1834.

The memory 1832 includes directional pre-processing logic 1831, combinatory processing logic 1835, and sound processing logic 1837. Memory 1832 may comprise read only memory (ROM), random access memory (RAM), magnetic disk storage media devices, optical storage media devices, flash memory devices, electrical, optical, or other physical/tangible memory storage devices. The at least one processor 1825 is, for example, a microprocessor or microcontroller that executes instructions for the directional preprocessing logic 1831, combinatory processing logic 1835, and sound processing logic 1837. Thus, in general, the memory 1832 may comprise one or more tangible (non-transitory) computer readable storage media (e.g., a memory device) encoded with software comprising computer executable instructions and when the software is executed (at least one processor 1825) it is operable to perform all or part of the techniques presented herein.

Transducer 1820 illustrates an example of a stimulator unit that receives the transducer drive signal(s) 1818 and generates stimulation (vibrations) for delivery to the skull of the recipient via a transcutaneous or percutaneous anchor system (not shown) that is coupled to bone conduction device 1800. Delivery of the vibration causes motion of the cochlea fluid in the recipient's contralateral functional ear, thereby activating the hair cells in the functional ear.

FIG. 18 also illustrates the power source 1826 that provides electrical power to one or more components of bone conduction device 1800. Power source 1826 may comprise, for example, one or more batteries. For ease of illustration, power source 1826 has been shown connected only to user interface 1824 and electronics module 1812. However, it should be appreciated that power source 1826 may be used to supply power to any electrically powered circuits/components of bone conduction device 1800.

User interface 1824 allows the recipient to interact with bone conduction device 1800. For example, user interface 1824 may allow the recipient to adjust the volume, alter the speech processing strategies, power on/off the device, etc. Although not shown in FIG. 18, bone conduction device 1800 may further include an external interface that may be used to connect electronics module 1812 to an external device, such as a fitting system.

It is to be appreciated that the above described embodiments are not mutually exclusive and that the various embodiments can be combined in various manners and arrangements.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method, comprising:

determining a plurality of first frequency components associated with a first directional microphone signal;

determining a plurality of second frequency components associated with a second directional microphone signal;

multiplying the first frequency components with the second frequency components to generate a cross-power signal;

converting the cross-power signal to an amplitude domain signal; and reconstructing a phase of the amplitude domain signal to generate an amplitude domain combinatory directional microphone signal from the amplitude domain signal and the phase.

2. The method of claim 1, wherein converting the cross-power signal to the amplitude domain signal comprises:

computing a square root of the cross-power signal to generate an intermediate signal; and removing any imaginary parts of the intermediate signal to generate the amplitude domain signal.

3. The method of claim 2, wherein removing any imaginary parts of the intermediate signal comprises:

computing an absolute value of the intermediate signal.

4. The method of claim 2, wherein removing any imaginary parts of the intermediate signal comprises:

computing a real part of the intermediate signal.

5. The method of claim 2, wherein removing any imaginary parts of the intermediate signal comprises:

computing an absolute value of the intermediate signal for positive numbers and setting negative numbers to zero.

6. The method of claim 1, further comprising:

computing an inverse Fourier transform on the amplitude domain combinatory directional microphone signal to generate a time-domain combinatory directional microphone signal.

7. The method of claim 6, further comprising:

filtering the time-domain combinatory directional microphone signal with a frequency filter configured to attenuate high frequencies and flatten the time-domain combinatory directional microphone signal across frequency to generate a frequency-adjusted combinatory directional microphone signal.

8. The method of claim 1, wherein reconstructing a phase of the amplitude domain signal comprises:

obtaining a phase signal from one or more of the first directional microphone signal or the second directional microphone signal.

9. The method of claim 1, wherein the first directional microphone signal and the second directional microphone signal are generated from a plurality of microphone signals corresponding to sound signals captured by a microphone array, and wherein reconstructing a phase of the amplitude domain signal comprises:

obtaining a phase signal from one or more of the plurality of microphone signals.

10. The method of claim 1, wherein the first and second frequency components are calculated with a specific frequency resolution to represent the amplitude domain signal without aliasing or distortion.

11. The method of claim 1, further comprising:

determining a first time domain signal associated with the first directional microphone signal;

determining a second time domain signal associated with the second directional microphone signal;

convolving the first time domain signal with the second time domain signal to generate a convolved signal; and converting the convolved signal to the amplitude domain to generate the amplitude domain combinatory directional microphone signal.

12. The method of claim 1, further comprising:

receiving sound signals at a microphone array comprising first and second microphones positioned along a microphone axis;

generating the first and second directional microphone signals from the sound signals received at the microphone array, and wherein the amplitude domain combinatory directional microphone signal is associated with a microphone pickup pattern that has at least one area of broad-side sensitivity.

13. A method, comprising:

receiving sound signals at a microphone array comprising first and second microphones positioned along a microphone axis;

generating first and second directional microphone signals from the sound signals received at the microphone array;

calculating a cross-power signal from a frequency element wise multiplication of the first and second directional microphone signals, in a frequency domain;

generating an amplitude domain signal from the cross-power signal; and reconstructing a phase of the amplitude domain signal to generate an amplitude domain combinatory directional microphone signal from the amplitude domain signal and the phase.

14. The method of claim 13, wherein the amplitude domain combinatory directional microphone signal is associated with a microphone pickup pattern that has at least one area of broad-side sensitivity.

15. The method of claim 13, wherein generating the amplitude domain signal comprises:

computing a square root of the cross-power signal to generate an intermediate signal; and removing any imaginary parts of the intermediate signal to generate the amplitude domain signal.

16. The method of claim 13, further comprising:

computing an inverse Fourier transform on the amplitude domain combinatory directional microphone signal to generate a time-domain combinatory directional microphone signal.

17. The method of claim 16, further comprising:

filtering the time-domain combinatory directional microphone signal with a frequency filter configured to attenuate high frequencies and flatten the time-domain combinatory directional microphone signal across frequency to generate a frequency-adjusted combinatory directional microphone signal.

18. The method of claim 13, wherein reconstructing a phase of the amplitude domain signal comprises:

reconstructing the phase of the amplitude domain signal from a phase of one or more of the first directional microphone signal or the second directional microphone signal.

19. The method of claim 13, wherein the first directional microphone signal and the second directional microphone signal are generated from a plurality of microphone signals corresponding to the sound signals captured by the microphone array, and wherein reconstructing a phase of the amplitude domain signal comprises:

reconstructing the phase of the amplitude domain signal from a phase of one or more of the plurality of microphone signals.

20. An auditory prosthesis, comprising:

a microphone array comprising first and second microphones positioned along a microphone axis;

a directional pre-processing module configured to generate first and second directional microphone signals from sound signals received at the microphone array; and a combinatory processing module configured to:

calculate a cross-power signal from a frequency element wise multiplication of the first and second directional microphone signals, in a frequency domain, convert the cross-power signal to an amplitude domain signal, and reconstruct a phase of the amplitude domain signal to generate an amplitude domain combinatory directional microphone signal from the amplitude domain signal and the phase.

21. The auditory prosthesis of claim 20, wherein the combinatory directional microphone signal is associated with a microphone pickup pattern that has at least one area of broad-side sensitivity.

22. The auditory prosthesis of claim 20, wherein to convert the cross-power signal to the amplitude domain signal, the combinatory processing module is configured to:

compute a square root of the cross-power signal to generate an intermediate signal; and remove any imaginary parts of the intermediate signal to generate the amplitude domain signal.

23. The auditory prosthesis of claim 22, wherein to remove any imaginary parts of the intermediate signal, the combinatory processing module is configured to:

compute an absolute value of the intermediate signal.

24. The auditory prosthesis of claim 22, wherein to remove any imaginary parts of the intermediate signal, the combinatory processing module is configured to:

compute a real part of the intermediate signal.

25. The auditory prosthesis of claim 20, further comprising:

an inverse Fourier transform processing block configured to perform an inverse Fourier transform on the amplitude domain combinatory directional microphone signal to generate a time-domain combinatory directional microphone signal.

26. The auditory prosthesis of claim 25, further comprising:

a frequency filter configured to attenuate only high frequency components of the time-domain combinatory directional microphone signal to flatten the time-domain combinatory directional microphone signal across frequency to generate a frequency-adjusted combinatory directional microphone signal.

27. The auditory prosthesis of claim 20, wherein to reconstruct the phase of the amplitude domain signal, the combinatory processing module is configured to:

extract phase information from one or more of the first directional microphone signal or the second directional microphone signal.

28. The auditory prosthesis of claim 20, wherein the first directional microphone signal and the second directional microphone signal are generated from a plurality of microphone signals corresponding to sound signals captured by the microphone array, and wherein to reconstruct the phase of the amplitude domain signal, the combinatory processing module is configured to:

extract phase information from one or more of the plurality of microphone signals.

29. The auditory prosthesis of claim 20, wherein the combinatory processing module is configured to:

generate a longer term amplitude estimate of the sound signals, and adjust a shorter term power signal of the amplitude domain combinatory directional microphone signal so as to approximate the longer term amplitude estimate of the sound signals.

* * * * *